US006653985B2

(12) United States Patent
Sikina et al.

(10) Patent No.: US 6,653,985 B2
(45) Date of Patent: Nov. 25, 2003

(54) MICROELECTROMECHANICAL PHASED ARRAY ANTENNA

(75) Inventors: Thomas V. Sikina, Acton, MA (US); Yueh-Chi Chang, Northboro, MA (US)

(73) Assignee: Raytheon Company, Lexington, MA (US)

( * ) Notice: Subject to any disclaimer, the term of this patent is extended or adjusted under 35 U.S.C. 154(b) by 44 days.

(21) Appl. No.: 09/954,516

(22) Filed: Sep. 17, 2001

(65) Prior Publication Data

US 2003/0184476 A1 Oct. 2, 2003

Related U.S. Application Data

(60) Provisional application No. 60/233,071, filed on Sep. 15, 2000.

(51) Int. Cl.[7] ..... H01Q 21/00
(52) U.S. Cl. ..... 343/853; 343/700 MS
(58) Field of Search ..... 343/700 MS, 853, 343/895, 767, 770, 771; H01Q 21/00

(56) References Cited

U.S. PATENT DOCUMENTS

| | | | | |
|---|---|---|---|---|
| 4,469,165 A | | 9/1984 | Ungarean et al. | |
| 4,605,934 A | | 8/1986 | Andrews | |
| 5,124,713 A | | 6/1992 | Mayes et al. | |
| 5,196,812 A | | 3/1993 | Drost et al. | |
| 5,266,961 A | | 11/1993 | Milroy | |
| 5,349,363 A | | 9/1994 | Milroy | |
| 5,361,076 A | | 11/1994 | Milroy | |
| 5,412,394 A | | 5/1995 | Milroy | |
| 5,483,248 A | | 1/1996 | Milroy | |
| 5,583,524 A | | 12/1996 | Milroy | |
| 5,619,061 A | | 4/1997 | Goldsmith et al. | |
| 5,719,975 A | | 2/1998 | Wolfson et al. | |
| 5,781,087 A | | 7/1998 | Milroy et al. | |
| 5,854,610 A | | 12/1998 | Wojtowicz et al. | |
| 5,905,472 A | | 5/1999 | Wolfson et al. | |
| 5,926,077 A | | 7/1999 | Milroy | |
| 5,995,055 A | | 11/1999 | Milroy | |
| 5,995,062 A | * | 11/1999 | Denney et al. | 343/853 |
| 6,020,853 A | | 2/2000 | Richards | |
| 6,075,494 A | | 6/2000 | Milroy | |

(List continued on next page.)

FOREIGN PATENT DOCUMENTS

| | | |
|---|---|---|
| EP | 0 887 879 A1 | 12/1998 |
| WO | WO0039890 | 7/2000 |
| WO | WO0039891 | 7/2000 |

OTHER PUBLICATIONS

Gardiol, Fred E. et al. "Broadband Patch Antennas—A SSIP Update", IEEE, 1996, pp. 2–5.
Tang Raymond et al. "Array Technology", Proceedings of the IEEE, vol. 80, No. 1, Jan. 1992, pp. 173–182.
Norvell, Bill R. et al. "Micro Electro Mechanical Switch (MEMS) Technology Applied to Electronically Scanned Arrays for Space Based Radar", XP–002188598, Jun. 3, 1999, pp. 239–247.

*Primary Examiner*—Hoanganh Le
(74) *Attorney, Agent, or Firm*—Daly, Crowley & Mofford, LLP

(57) ABSTRACT

An array antenna includes a radiator layer having first and second opposing surfaces and a plurality of radiators disposed on a first surface of the radiator layer. Additionally the antenna includes a microelectromechanical systems (MEMS) layer with a plurality of MEMS phase shifters disposed adjacent to the second surface of the radiator layer, each one of the plurality of MEMS phase shifters electromagnetically coupled to at least one of the plurality of radiators. Finally, a beamformer layer is electromagnetically coupled to the MEMS layer, and a spacer layer is disposed between the MEMS layer and the beamformer layer. A second embodiment is provided from multiple layers and utilizes a plurality of subarray structures which are coupled to form the entire array aperture.

64 Claims, 18 Drawing Sheets

U.S. PATENT DOCUMENTS 6,101,705 A 8/2000 Wolfson et al.
6,154,176 A 11/2000 Fathy et al.
6,184,827 B1 2/2001 Dendy et al.
6,184,832 B1 * 2/2001 Geyh et al. ..... 343/700 MS
6,185,107 B1 2/2001 Wen
6,198,438 B1 3/2001 Herd et al.
6,232,919 B1 * 5/2001 Marumoto et al. .. 343/700 MS
6,396,440 B1 * 5/2002 Chen ..... 343/700 MS
6,441,787 B1 * 8/2002 Richards et al. ..... 343/700 MS

* cited by examiner

MICROELECTROMECHANICAL PHASED ARRAY ANTENNA

CROSS-REFERENCE TO RELATED APPLICATIONS

This application claims the benefit of U.S. Provisional Application No. 60/233,071, filed on Sep. 15, 2000 which application is hereby incorporated herein by reference in its entirely.

STATEMENTS REGARDING FEDERALLY SPONSORED RESEARCH

Not applicable.

FIELD OF THE INVENTION

This invention relates to radio frequency (RF) antennas and more particularly to an RF phased array antenna.

BACKGROUND OF THE INVENTION

As is known in the art, satellite communication systems include a satellite which includes a satellite transmitter and a satellite receiver through which the satellite transmits signals to and receives signals from other communication platforms. The communication platforms in communication with the satellite are often located on the surface of the earth or, in the case of airborne platforms, some distance above the surface of the earth. Communication platforms with which satellites communicate can be provided, for example, as so-called ground terminals, airborne stations (e.g. airplane or helicopter terminals) or movable ground based stations (sometimes referred to as mobile communication systems). All of these platforms will be referred to herein as ground-based platforms.

To enable the transmission of radio frequency (RF) signals between the satellite and the ground-based platforms, the ground-based platforms utilize a receive antenna which receives signals from the satellite, for example, and couples the received signals to a receiver circuit in the ground-based platform. The ground-based platforms can also include a transmitter coupled to a transmit antenna. The transmitter generates RF signals which are fed to the transmit antenna and subsequently emitted toward the satellite communication system. The transmit and receive antennas used in the ground-based platforms must thus be capable of providing a communication path between the transmitter and receiver of the ground-based platform and the transmitter and receiver of the satellite.

To establish communication between one or more satellites and the ground-based platform, the antenna on the ground-based platform must be capable of scanning an antenna beam to first locate and then follow the satellite. One approach to scanning an antenna beam is to mechanically steer the antenna mount. This can be accomplished, for example, by mounting an antenna on a gimbal. Some prior art ground-based platforms, for example, utilize gimbal mounted reflector antennas.

Gimbal mounted reflector antennas are relatively simple and low cost antennas. One problem with such antennas, however, is that gimbal-mounted reflector-type antennas are relatively large and bulky and thus do not have an attractive appearance. In addition, such relatively large structures with moving parts can be relatively difficult to mount on platforms such as automobiles and residential homes. Moreover, such antennas can have problems due to animals (e.g. birds) landing on and the antenna and causing it to move.

Furthermore, since gimbal-mounted antennas are not typically low profile antennas, objects (e.g. trees) can hit the antenna and breaking the antenna or the gimbal. Moreover, gimbal mechanisms require maintenance which can be costly and time-consuming.

Another type of antenna capable of scanning the antenna beam is an electronically steerable phased array (ESA) antenna. ESA antennas can be low profile and made to have a relatively attractive appearance. One problem with ESA antennas, however, is that they are relatively expensive. Thus, ESA antennas are not typically appropriate for use with low cost ground-based platforms.

It would, therefore, be desirable to provide a reliable antenna having a relatively low profile and which is relatively compact compared with the size of a gimbal mounted reflector antenna and which is relatively low cost compared with relatively expensive conventional ESA antenna.

SUMMARY OF THE INVENTION

In accordance with the present invention, an antenna includes a radiator layer having first and second opposing surfaces and a plurality of radiators disposed on a first surface of the radiator layer. Additionally the antenna includes a microelectromechanical systems (MEMS) layer with a plurality of MEMS phase shifters disposed adjacent to the second surface of the radiator layer, each one of the plurality of MEMS phase shifters electromagnetically coupled to at least one of the plurality of radiators. Finally, a beamformer layer is electromagnetically coupled to the MEMS layer, and a spacer layer is disposed between the MEMS layer and the beamformer layer.

With such an arrangement, an antenna is an electronically steerable phased array which is relatively compact, planar and has a relatively low profile and no moving parts. Because of the relatively low loss connections between the layers of the antenna and the reduced losses in the MEMS phase shifters, such an antenna requires no amplifiers between the beamformer layer and the radiator layer, providing a passive phased array having relatively low internal losses. The passive phased array reduces the complexity of the antenna and costs associated with fully populated active phased array antennas. No motors are needed to operate the antenna, so there is no motor noise, or single point failure modes associated with motor controlled devices. The antenna's low loss characteristics provide a better noise figure (NF) and gain characteristic than prior art antennas. The antenna's gain performance is equivalent to prior art antennas having a larger aperture.

A second embodiment is provided from antenna having a subarray driver and a plurality of subarrays. Each such subarray includes a plurality of output ports, a plurality of input ports, a microelectromechanical systems (MEMS) layer having a plurality of MEMS phase shifters, and each of the plurality of MEMS phase shifters coupled to a respective one of the subarray outputs. Additionally, each subarray has a plurality of radiators disposed on a radiator layer, and each of the plurality of radiators coupled to a respective one of the plurality of MEMS phase shifters.

With such an arrangement of multiple layers and plurality of subarray structures the entire antenna array aperture can be formed with a rectangular shape having an arbitrary size. Because of the relatively low loss connections between the layers of the subarrays and the reduced losses in the MEMS phase shifters, such an antenna requires no amplifiers in the subarrays, providing a passive phased array having relatively low internal losses.

In accordance with another aspect of the present invention, the antenna includes a subarray driver having a plurality of transmit circuits and a plurality of receive circuits, a plurality of subarrays. The subarrays have a diplexer with a transmit port and a receive port, the transmit port coupled to the respective transmit circuit and the receive port coupled to the respective receive circuit; a subarray beamforming layer having a plurality of output ports. Additionally, the subarrays have a plurality of diplexers having a first port coupled to a respective one of the subarray output ports, a second port and a third port. Finally, the subarray has a microelectromechanical systems (MEMS) layer with a plurality of pairs of MEMS phase shifters, each of a first one of the pair coupled to a respective one of the second port, and each of a first one of the pair coupled to a respective one of the third port, and a plurality of radiators disposed on a radiator layer, each of the plurality of radiators coupled to a respective pair.

With such an arrangement, the antenna is able to operate in a full duplex mode whereby the antenna can simultaneously transmit and receive through a single aperture. Additionally the antenna is capable of independently directing the transmit and receive beams to one of multiple satellites within its scan volume. The antenna has dual simultaneous polarization (i.e. the polarizations for the receive and transmit sub-bands are opposite sense circular and simultaneous). The antenna is fixed during operation and can point transmit and receive beams independently within the scan volume.

In each of the above embodiments, the antenna is provided from manufacturing and assembly techniques that result in the antenna having relatively low losses. Furthermore, the MEMS phase shifters are provided as relatively low loss devices. The combination of the low antenna losses and the low loss phase shifters allows a transmit path of the antenna to use fewer transmit amplifiers compared with the number of amplifiers required in a transmit path of a conventional phased array antenna. Likewise, the combination of the low antenna losses and the low loss phase shifters allows a receive path of the antenna to use fewer receive amplifiers compared with the number of amplifiers required in a receive path of a conventional phased array antenna. Since the antenna includes fewer transmit and receive amplifiers, the antenna can be assembled using relatively simply assembly techniques and the antenna is provided as a relatively low cost phased array antenna.

DESCRIPTION OF THE DRAWINGS

The foregoing features of this invention, as well as the invention itself, may be more fully understood from the following description of the drawings in which.

DETAILED DESCRIPTION OF THE INVENTION

Figure 1:
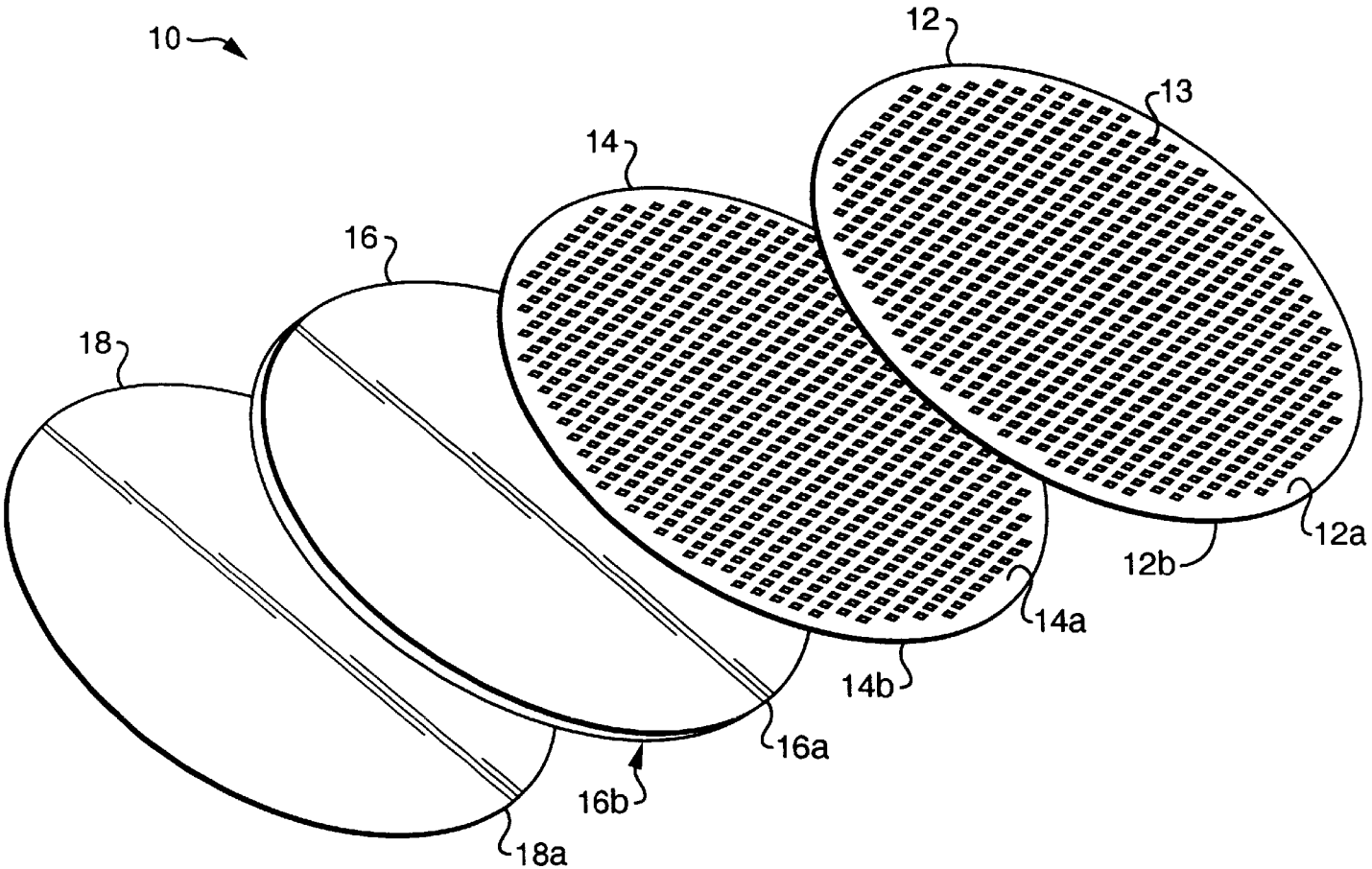
FIG. 1 is an exploded perspective view of an electronically steerable phased array antenna according to the present invention.

Referring now to FIG. 1, an antenna 10 includes a radiator layer 12 having a first surface 12*a* over which are disposed a plurality of radiators 13 and a second opposing surface 12*b* disposed over a first surface 14*a* of a microelectromechanical systems (MEMS) layer 14. A second opposing surface 14*b* of the MEMS layer 14 is disposed over a first surface 16*a* of a spacer layer 16 and a second opposing surface 16*b* of the spacer layer 16 is disposed on over a first surface 18*a* of a beamformer layer 18.

In one particular embodiment, the radiators 13 are provided as patches disposed on or otherwise coupled to the radiator layer 12. It will be appreciated by those of ordinary skill in the art, that various types of radiator elements can be used in the radiator layer, including but not limited to patches, stacked patches, and stubs. The radiators 13 may be provided by disposing the radiators 13 on the first surface 12*a* of the radiator layer 12 using an additive process such as a metal deposition technique or using a subtractive process such as a patterning process or a subtractive etching process.

The MEMS slot layer 14 includes phase shifters (not visible in FIG. 1) which are provided to electronically steer the radiation emitted by the radiator layer 12. In one embodiment, the phase shifters are provided as MEMS phase shifters controlled by CMOS logic. In such an embodiment, to be described in detail below, the MEMS phase shifters are provided from MEMS switches, and stripline circuits coupled to the radiating elements. The MEMS phase shifters can be of the type as described in the U.S. Pat. No. 6,020,853 entitled "Microstrip Phase Shifting Reflect Array Antenna," issued on Feb. 1, 2000, assigned to the assignee of the present invention and incorporated herein by reference in its entirety. The MEMS phase shifters are constructed from MEMS devices (not shown). Such devices use electromechanical methods to change the phase state a unit cell. In one embodiment, the MEMS phase shifters are composed of silicon ships that are attached to a dielectric substrate of the MEMS layer via a Ball-Grid Array (BGA).

The spacer layer 16, here for example, a relatively low loss dielectric foam material (e.g. Rogers R/T Duroid®) operates as part of the feed network between the MEMS layer 14 and the beamformer layer 18 to couple electromagnetic field signals between the radiators and a feed system in a transmit mode or a receive mode.

In transmit mode, the beamformer layer 18 couples RF energy generated from a transmitter and distributes the radiation into the spacer layer 16 which is then coupled into the MEMS layer 14. The beamformer layer 18, the spacer layer 16 and the lower part of the MEMS layer 14 operate to provide feed signals with adjustable phase which are coupled to the radiators on the radiator layer 12. In receive mode, the beamformer layer 18 also couples radiation received by the radiators distributed into the MEMS layer 14, the spacer layer 16 and the beamforming layer 18 into the receiver circuitry (not shown).

The arrangement shown in FIG. 1 provides an antenna having only four layers. Since the antenna 10 includes only four layers, the antenna can be provided as an integrated antenna array having a relatively simply mechanical structure while still providing an electronic scanning capability. An integrated antenna array is an antenna system having multiple layers which are coupled together (as will be described below in conjunction with FIGS. 3–9) to reduce the signal loss at the operating frequencies which in one embodiment eliminates the necessity for additional amplification to be provided between the radial beamformer layer 18 and the radiator layer 12.

By combining the layers in the manner shown in FIG. 1, the number of plated through holes (PTH) (also referred to as via's) are reduced over conventional designs to further reduce the loss characteristics among the beamformer layer 18, spacer layer 16, MEMS layer 14 and radiator layer 12. Also, the MEMS phase shifters provided in the MEMS layer 14 of the antenna are integrated with other components having a relatively low insertion loss characteristic which further enhances the low loss characteristic of the antenna and also reduces the need for amplifier circuits in the antenna. In one embodiment, the MEMS layer 14 includes capacitive MEMS switches having low loss characteristics. Thus the antenna is provided having a relatively low loss characteristic.

Figures 2, 2A:
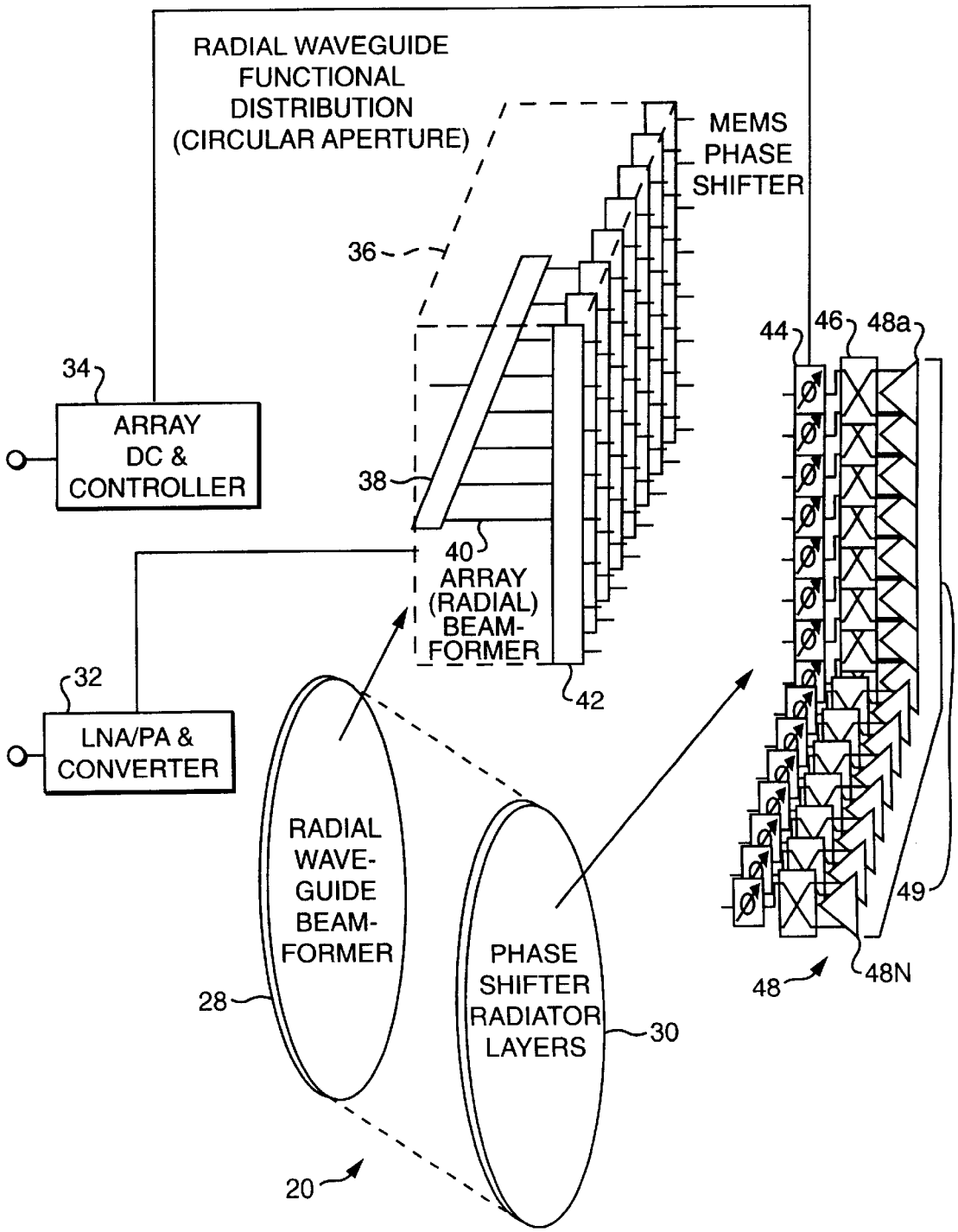
FIG. 2 is an exploded block diagram view of an integrated electronically steerable phased array antenna system.
FIG. 2A is a schematic diagram of a beamformer and a block diagram of MEMS phase shifters, polarization circuits and radiators of the of the antenna system of FIG. 2.

Referring now to FIGS. 2 and 2A, an integrated antenna 20 includes a common transmit aperture and receive aperture and having an optional radome 49 disposed thereover. The radome 49 is disposed over an integrated antenna assembly provided from integrated phase shifter and radiator layers 30 which are coupled to a beamformer layer 28, here a radial waveguide beamformer. The beamformer layer 28 is coupled to a low noise amplifier (LNA), power amplifier (PA) and converter module 32. It will be appreciated by those of ordinary skill in the art, that two antennas can be configured as separate transmit and receive apertures sharing a common radome, or the antenna 20 can be provided as a narrow band antenna or a broadband antenna by using corresponding narrow band or broadband components and techniques.

The radome in one embodiment is composed of a thin dielectric membrane tilted at a small inclination angle. Using such a structure affects the appearance of the antenna, the radome cost, and because of the relatively low loss of the radome, the cost of the antenna array. When operating in receive mode, an incident plane wave signal passes through the radome 49 with minimal attenuation.

As shown in one embodiment in FIG. 2A an array direct current (DC) distribution and controller circuit 34 is coupled to the MEMS phase shifters 44 provided in the integrated phase shifter and radiator layers 30. The DC distribution and controller circuit 34 provides power to the layers 30 (FIG. 2) and in particular, as shown in FIG. 2A, the circuit 34 provides power to the MEMS phase shifters 44 which are provided as MEMS phase shifters 44.

The beamformer layer 28, in one embodiment, includes an array beamformer 36 having a first 16:1 beamformer circuit 38. Each of a plurality of output ports 40 of the first beamformer circuit 38 is coupled to corresponding input port of a second plurality of 16:1 beamformer circuits 42. Each of a plurality of outputs of the second plurality of beamformer circuits 42 (FIG. 2A) is coupled to a first port of respective one of a plurality of MEMS phase shifter circuits 44. A second port of each of the plurality of MEMS phase shifter circuits 44 is coupled to a first port a plurality of hybrid circuits 46. It should be noted that each of the hybrid circuits 46 is provided as a four port device and that two of the hybrid ports are coupled to different MEMS phase shifters 44 and two of the hybrid ports are coupled to a single one of a plurality of radiating elements 48. Thus, each of the radiating elements $\mathbf{48}_a$–$\mathbf{48}_N$ have a pair of antenna ports with each of the antenna ports coupled to first and second ports of respective ones of the hybrid circuits 46.

Because the integration of the MEMS phase shifters and the reduced number of interconnects provides the integrated antenna assembly having a relatively low loss characteristics, the antenna 20 as shown in FIG. 2 does not require additional power amplifiers and associated signal, power and control connections to be in inserted between the adjacent layers. The absence of these additional interconnections, allows the fabrication of a relatively low profile and relatively low cost antenna system.

The integrated electronically steerable phased antenna array 20 is capable of independently directing the transmit and receive beams to one of multiple satellites within its scan volume. The antenna 20 is designed to operate over a range of frequencies, and in one embodiment the range covers from 28.6 Ghz–29.1 Ghz and from 18.8 Ghz to 19.3 Ghz. The antenna uses no additional transmit and receive amplifiers in the beamformer and radiator layer providing a passive phased array, and as such has low internal losses and avoids to the complexity and cost associated with fully populated active phased array antennas. The design principles used allow the use of low cost, simple manufacturing techniques.

Figure 3:
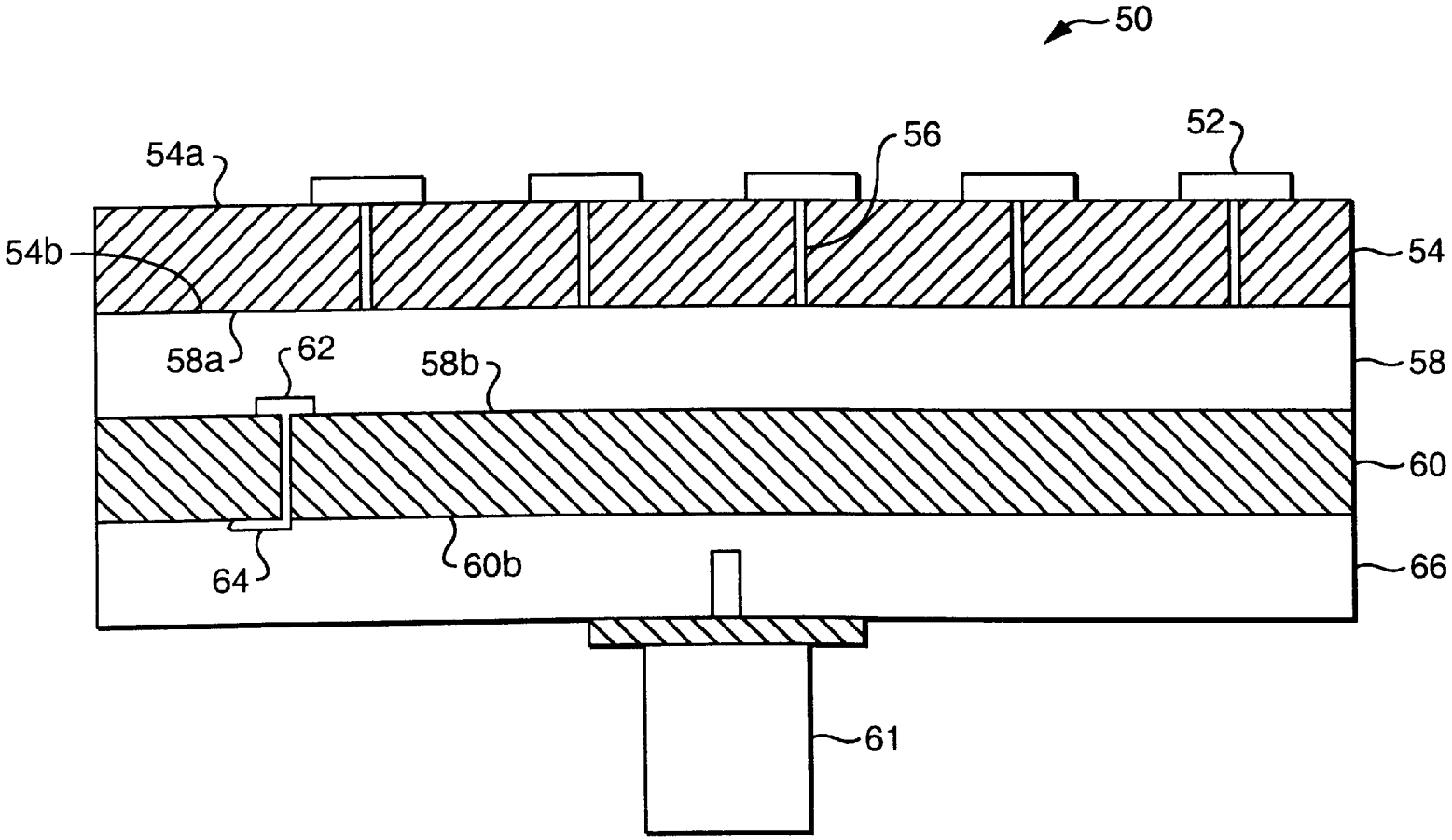
FIG. 3 is a functional block diagram of one embodiment of the antenna array of FIG. 1 having via coupled radiators.

Referring now to FIG. 3, an integrated antenna 50 includes a radiator layer 54 having a first surface 54*a* over which are disposed a plurality of radiating antenna elements, or more simply radiators 52, here for example patches and a second opposing surface 54*b* disposed over a first surface 58*a* of a MEMS layer 58. The plurality of radiators 54 are coupled to the MEMS layer 58 by a plurality of probes 56. In one embodiment, the radiators 52 may be provided as so-called "patch" radiators having a size and shape selected to be responsive to RF energy in a particular frequency range. The radiators may be provided having a rectangular shape, a circular shape or even an irregular shape. The particular size and shape of each of the radiators is selected in accordance with the particular application in which the antenna 50 will be used.

A metal contact surface 58*a* of the MEMS layer 58 is disposed between the plurality of probes 56 and the MEMS phase shifters (now shown) in the MEMS layer 58. The metal contact surface 58*a* couples RF energy between the MEMS phase shifters and the probes 56. The MEMS layer 58 further includes stripline transmission circuitry (not shown) disposed over a plurality of feeds 62 which are disposed on a first surface 60*a* of a spacer layer 60. A second surface 60*b* of the spacer layer 60 is disposed on over a first surface 66*a* of a beamformer layer 66. A plurality of via's 63 couples the plurality of feeds 62 to a plurality of plated coupling features 64 disposed on the second surface 60*b* of the spacer layer 60. A signal feed 61, here for example, a single coaxial port is coupled to the beamformer layer 66. Conventional techniques, such as conductive bonding or solder reflow can be used to join the MEMS layer 54 including the metal contact surface 58*a* with the radiator layer 58.

In operation as a receiver, an incident plane wave signal passes through the radome (not shown) with minimal attenuation. The radiators 52 convert this incident field into TEM fields. In one embodiment to be described below in conjunction with FIGS. 9–9B, the radiators 52 convert the incident field into TEM fields at two ports provided in each radiator of the antenna. The received signal is coupled to the first surface 58*a* of the MEMS layer 58 through probe 56. Radiator layer 54 includes multiple layers (not shown) which include circuit features which couples the single point connection at probe 56 to two ports of the radiator 52.

The MEMS layer 58 includes, polarizing circuits, MEMS phase shifters, and stripline transmission lines integrated together to process the signals through a metal contact surface 58*b* coupled to plated coupling features 62 with relatively low loss. The MEMS layer 58 is fabricated using MEMS techniques to provide the MEMS phase shifter with MEMS switches having relatively low insertion loss and switching characteristics. Because of the relatively low loss in the coupling from radiators 52 to the signal feed 61 there is no requirement for additional amplification between the adjacent layers of the array antenna 50. The MEMS switches and the interconnections between the layers can be of the type as described in the U.S. patent application Ser. No. 09/756,801 filed on Jan. 10, 2001 entitled "Wafer Level Interconnection", assigned to the assignee of the present invention and incorporated herein by reference in its entirety.

Operating in transmit mode, a signal originates from a transmitter circuit and is coupled into the beamformer layer 66 through the signal feed 61, here for example, a coax feed. The signal processing and the coupling of the signal between adjacent layers of the array antenna 50 is similar to the coupling described above when the array antenna 50 is operating in receive mode.

Figure 4:
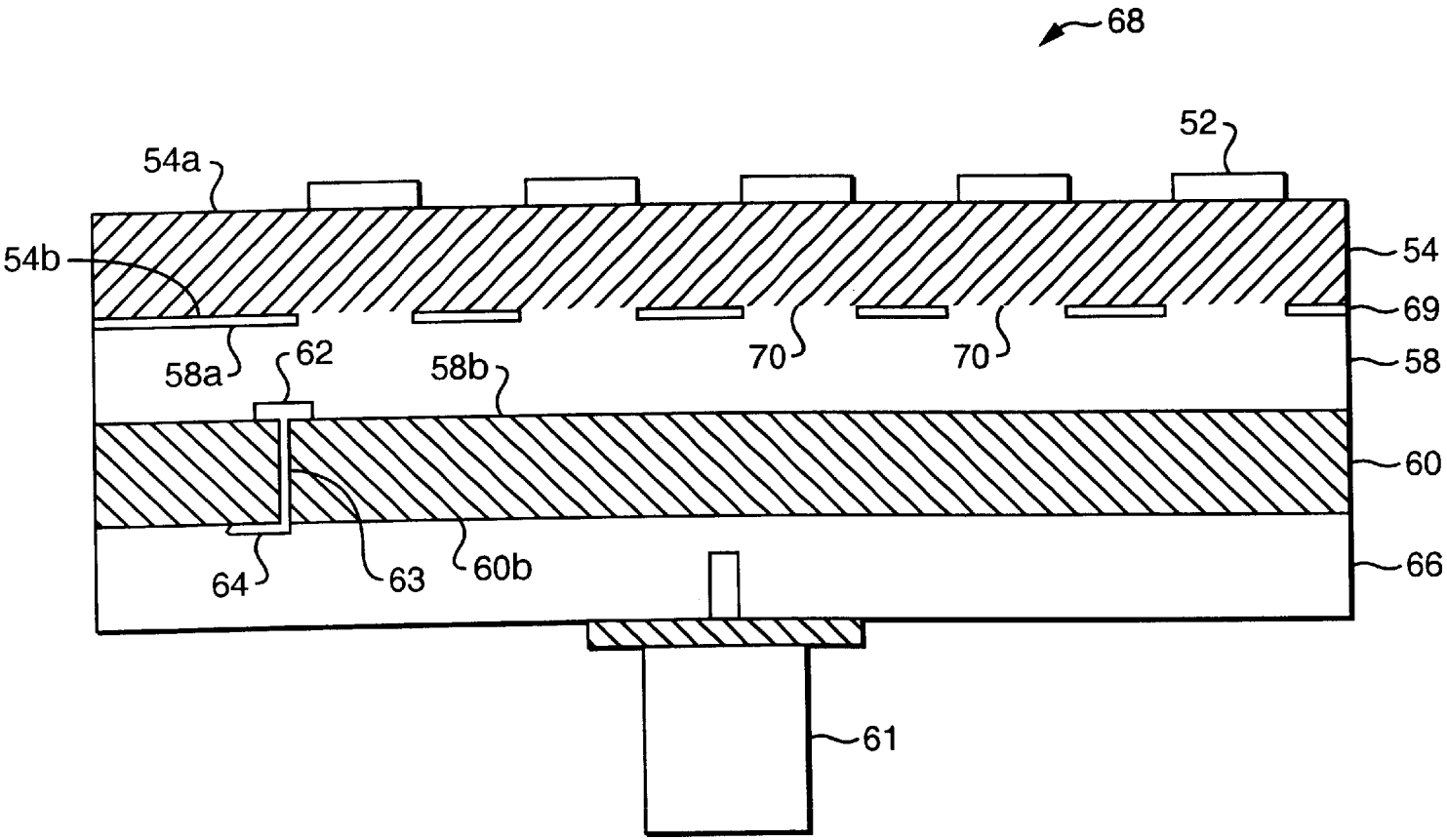
FIG. 4 is a functional block diagram of an alternate embodiment of the antenna of FIG. 1 having aperture coupled radiators.

Referring now to FIG. 4, in which like elements of FIG. 3 are provided having like reference designations, an integrated array antenna 68 includes a radiator layer 54 having a first surface 54*a* over which are disposed a plurality of radiating antenna elements, or more simply radiators 52, and a second opposing surface 54*b* disposed over a first surface 58*a* of a MEMS layer 58. The plurality of radiators 54 are coupled to the MEMS layer 58 by a plurality of apertures 70 disposed on a second surface 54*b* of the radiator layer 54. In one embodiment, the radiators 52 may be provided as so-called "patch" radiators having a size and shape selected to be responsive to RF energy in a particular frequency range. The radiators may be provided having a rectangular shape, a circular shape or even an irregular shape. The particular size and shape of each of the radiators is selected in accordance with the particular application in which the antenna 68 will be used.

The apertures 70 are formed, for example, in a copper layer 69 disposed on the second opposing surface 54*b* and are fabricated using one of several methods known in the art. In contrast to conventional means for coupling phase shifters to radiators, coupling provided by apertures 70 is relatively low loss. Conventional techniques, such high temperature, low pressure bonding can be used to join the MEMS layer 58 with the radiator layer 54.

A stripline circuit (not shown) of the MEMS layer 58 is disposed between the plurality of apertures 70 and the MEMS phase shifters (not shown) in the MEMS layer 58. The stripline circuit couples RF energy between the phase shifters and the apertures 70. The MEMS layer 58 further includes stripline transmission circuitry connecting the plurality of feeds 62 which are disposed on a first surface 60*a* of a spacer layer 60. A second surface 60*b* of the spacer layer 60 is disposed on over a first surface 66*a* of a beamformer layer 66. A plurality of via's 63 couple the plurality of feeds 62 to a plurality of plated coupling features 64 disposed on the second surface 60*b* of the spacer layer 60. A signal feed 61, here for example a single coaxial port is used to couple RF energy to transmit and receive circuits disposed in the beamformer layer 66.

In operation as a receiver, an incident plane wave signal passes through the radome (not shown) with minimal attenuation. The radiators 52 convert this incident field into TEM fields. The received signal is electromagnetically coupled to the first surface 58*a* of the MEMS layer 58 through aperture 70 to microstrip circuitry. The operation of the MEMS layer 58 and the signal feed 61 are similar to the operation as was described above in conjunction with the probe coupled embodiment of FIG. 3. Because of the relatively low loss in the coupling from radiators 52 to the signal feed 61 there is no requirement for additional amplification between the adjacent layers of the array antenna 68.

Figure 5:
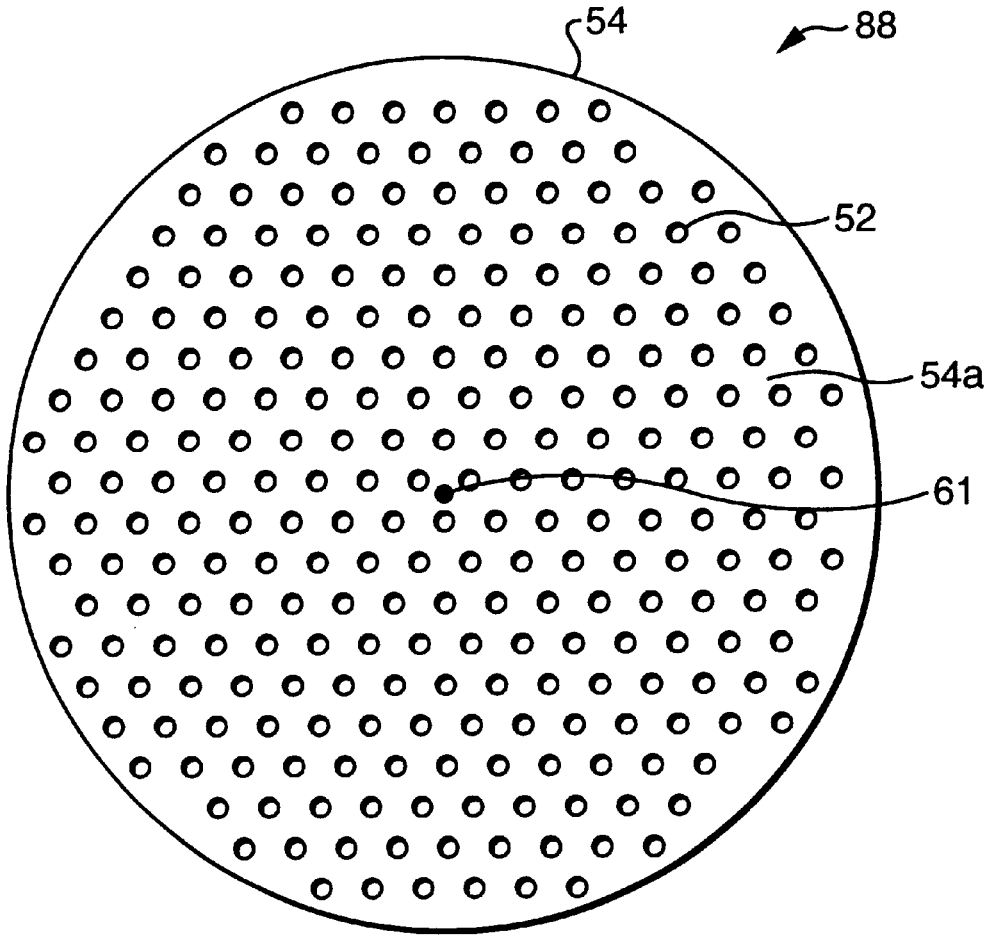
FIG. 5 is a plan view of a radial parallel-plate waveguide beamformer.

Referring now to FIG. 5, in which like elements of FIG. 3 are provided having like reference designations, a radiator layer 54 having a first surface 54*a* over which are disposed a plurality of radiating antenna elements, or more simply radiators 52, here for example patches and a second opposing surface 54*b* disposed over a first surface 58*a* of a MEMS layer 58. The plurality of radiators 54 are coupled to the MEMS layer 58 (not visible) by a plurality of via's 56 (not visible).

The radiator layer 54 provides a relatively narrow frequency band, for example, a transmit frequency range of 28.6 Ghz–29.1 Ghz and receive frequency range of 18.8 Ghz to 19.3 Ghz. The coupled ports are designed to offset $r^{-1}$ spreading loss. Ohmic losses are relatively low and the peripheral coupling port is designed to match the waveguide impedance coaxial interface to a power amplifier/low noise amplifier. The simple integrated design, the absence of plated through holes (PTH), and the aperture coupling of the radiator layer 54 to the integrated MEMS substrate (not shown) coupled to a beamformer (not shown) provides a passive phased array which can be fabricated with relatively low manufacturing costs.

Figure 6:
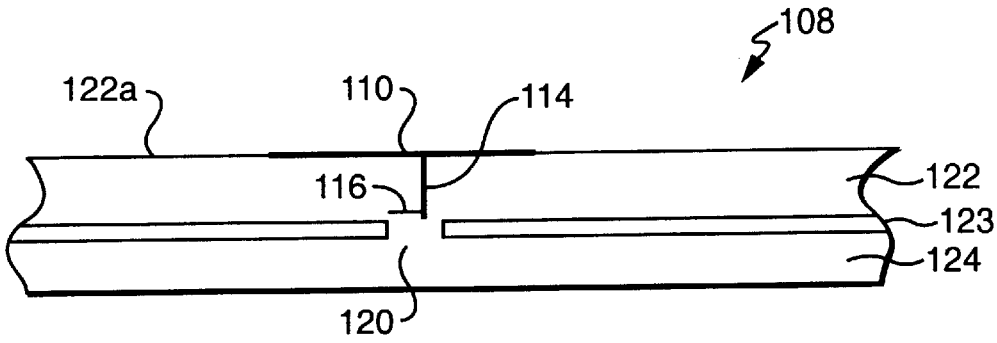
FIG. 6 is a functional block diagram of a circularly polarized slot patch radiator having probe coupling.
Figure 6A:
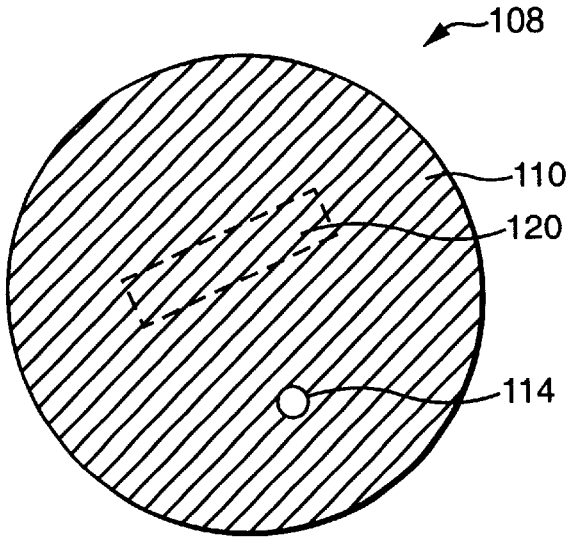
FIG. 6A is a top view of the radiator of FIG. 6.

Referring now to FIGS. 6 and 6A, a circularly polarized (CP) slot patch radiator 108 includes a patch 110 disposed on a first surface 122*a* of a radiator layer 122. The patch 110 includes a probe 114 and a slot 120 (also referred to as an aperture coupler) disposed in a slot layer 123. The probe 114*a* is disposed in radiator layer 122. A coupling feature 116 is disposed between the radiator layer 122 and a MEMS layer 124 is coupled to the probe 114. The probe 114 is coupled to a MEMS substrate 124 through the slot 120 which is disposed between the radiator layer 122 and the MEMS layer 124. An antenna includes a plurality of the CP slot patch radiators similar to patch radiator 108.

In one embodiment, the radiator 108 is asymmetric having the slot 120 offset from the probe 114, as shown in FIG. 6A. Alternatively, the radiator 108 can be symmetric having the slot 120 aligned with the center of the probe 114.

In operation, narrow band circularly polarized (CP) excitation of the patch, here for example, circular shaped patch 110, produces circularly polarized signals. In one embodiment, the probe 114 is aperture coupled to a cascaded 4-bit insertion MEMS phase shifter (not shown) disposed in the MEMS substrate 124. The use of aperture coupling and the single probe 114 for each patch 110 provides low loss characteristics which eliminate the requirement of additional amplifiers between the layers and facilitates relatively low cost manufacturing and relatively low profile construction.

Figure 7A:
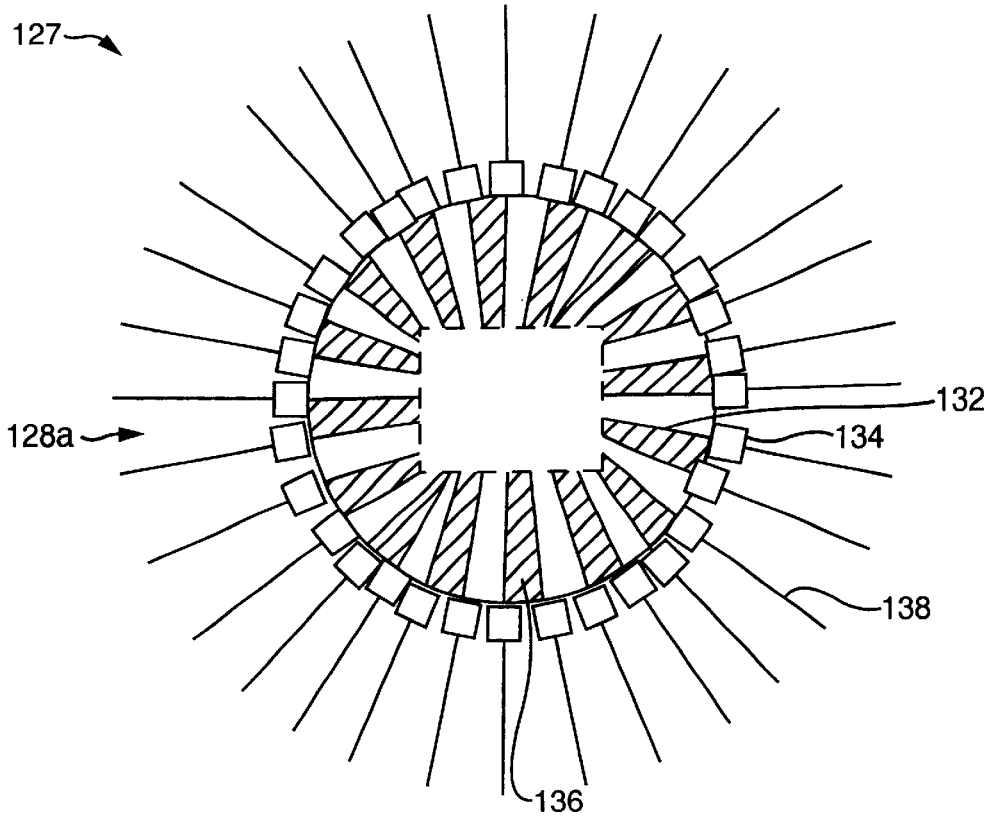
FIG. 7A is a plan view of the integrated MEMS phase shifter and radiator of FIG. 7.
Figure 7:
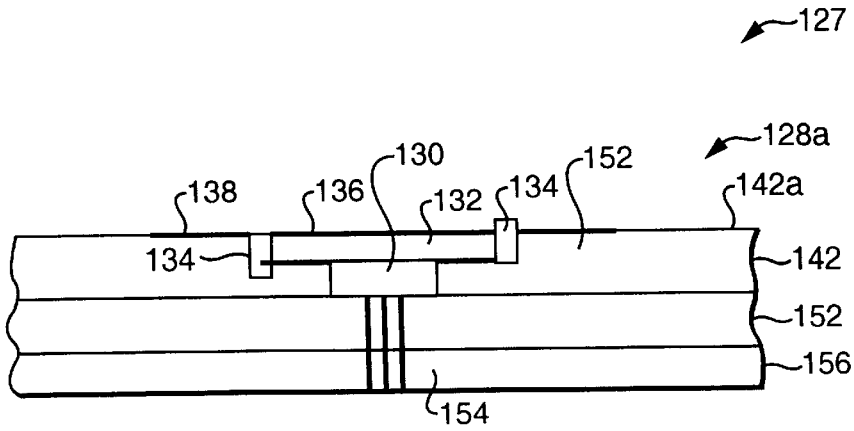
FIG. 7 is a cross-sectional view of an integrated MEMS phase shifter and radiator.
Figure 7B:
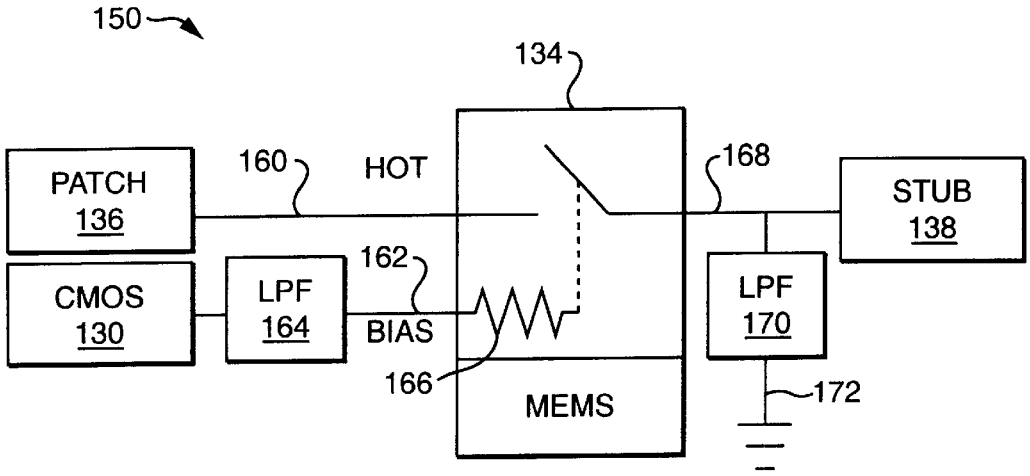
FIG. 7B is a schematic block diagram of the integrated MEMS phase shifter and radiator of FIG. 7.
Figure 7C:
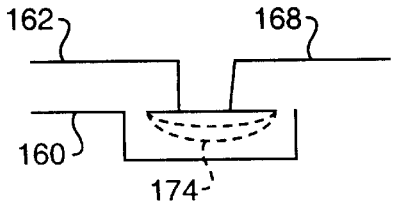
FIG. 7C is a schematic diagram of the MEMS layout of integrated MEMS phase shifter and radiator of FIG. 7.

Referring now to FIGS. 7–7C, antenna 127 includes an integrated phase shifter and radiator 128 which includes a patch radiator 136 and a plurality of stubs 138 disposed on a first surface 142*a* of a radiator layer 142. The radiator layer 142 is disposed on a MEMS substrate 152. A signal distribution circuit 132 is disposed on the MEMS substrate 152 and is adjacent a portion of the patch 136. U.S. Pat. No. 6,020,853 describes details of an exemplary distribution circuit. The distribution circuit 132 is coupled to at least one MEMS switching circuit 134 which is disposed on the MEMS substrate 152. A CMOS control circuit 130 is disposed on the MEMS substrate 152 and is coupled to the MEMS switching circuit 134 and the distribution circuit 132 and is also connected to DC and logic circuits (not shown) through via's 154 which pass through a radio frequency (RF) substrate 156 which is disposed adjacent to the MEMS substrate 152. In one embodiment as shown in FIGS. 7 and 7A, the stubs 138 are disposed in a radial pattern about the radiator and the CMOS control circuit 130 in the center. The operation of the MEMS phase shifters is further described in U.S. Pat. No. 6,020,853.

Referring now to FIGS. 7B and 7C, a circuit 150 corresponding to the integrated radiator and a MEMS phase shifter 128 is shown. The circuit 150, for example, includes a MEMS switch 134 (shown in an open position) having a first contact 160 coupled to the patch 136 and a second contact connected to a stub 138 and a first port of a low pass filter 170. An actuator 166 is coupled to a control contact 162 to control the operation of the switch 134. A second port of the first low pass filter (LPF) 164 is coupled to the CMOS control circuit 130. In one embodiment, the MEMS switch 134 is a capacitive MEMS switch. It will be appreciated by those of ordinary skill in the art, that a plurality stubs can be coupled to a plurality of radiators and switches, and the switch actuator 166 can be a cantilever or other mechanism compatible with MEMS fabrication and that the switch contacts 160, 162, and 168 can include liquid metal or other materials for improved performance.

Referring now also to FIGS. 7A and 7B, in operation, the integrated phase shifter and radiator 127 includes a plurality of unit cells 128. The unit cell 128 includes the radiating and phase shifting functions, having in one embodiment, two MEMS switches 134 per phase state. In one embodiment, a 4-bit MEMS phase shifter is provided to provide an RF signal having CP excitation. In another embodiment only one MEMS switch is used per phase state.

The CMOS control circuit 130 (FIG. 7A) selectively supplies a control signal which is filtered by the LPF 164 to eliminate noise to the control actuator 166 which switches MEMS switch 134 to an open or closed position. In the closed position, the MEMS switch 134 activates stub 138 by connecting first contact 160 to the second contact 168. In the closed position, the stub 138 is coupled to patch 136 rotating the unit cell 128*a*, producing a reflected wave phase shift. In the open position, the stub 138 is uncoupled from the patch 136. The rotation of the unit cell 128 is further described in U.S. Pat. No. 6,020,853.

The arrangement of the active stubs 138 determines the amount of the phase shift. The integration of the CMOS control circuit 130 including bias and isolation circuits, the MEMS switches, with the stubs 138 and patches 136 provides low loss characteristics for the combined radiating and phase shifting functions.

Figure 8A:
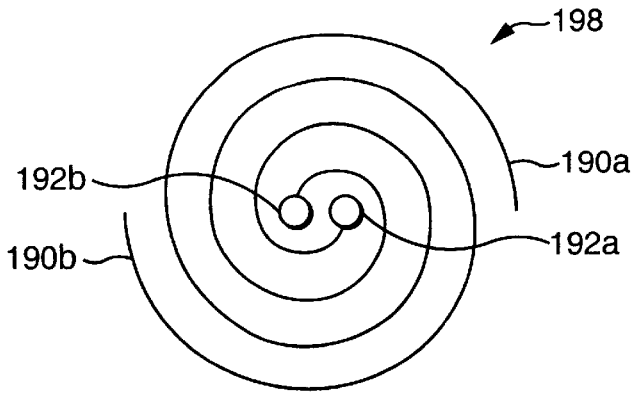
FIG. 8A is a schematic diagram of the spiral patch radiator of including plated through holes of FIG. 8.
Figure 8B:
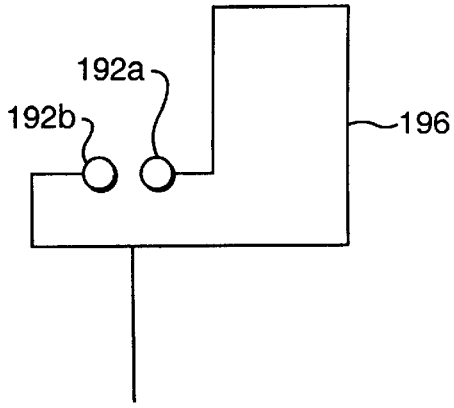
FIG. 8B is a schematic diagram of the feed circuit of a spiral patch in the radiator layer of FIG. 8.
Figure 8:
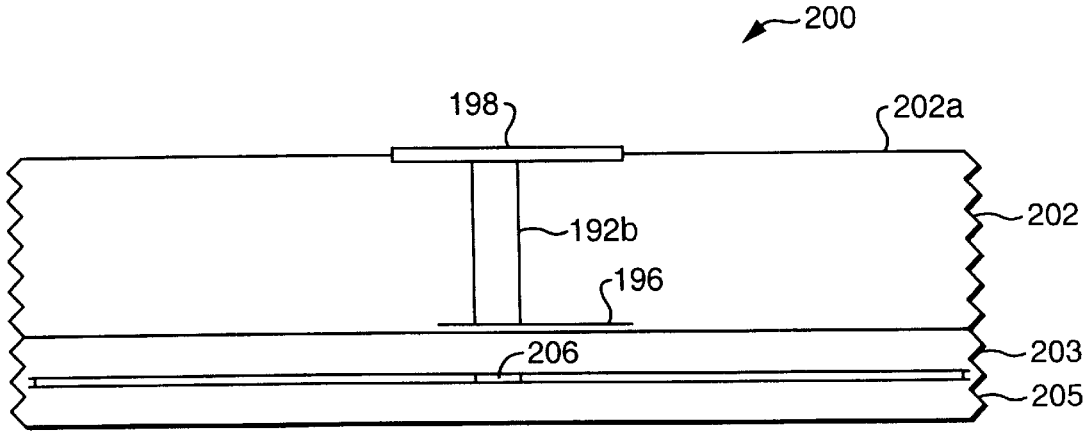
FIG. 8 is a cross-sectional view of a MEMS substrate and radiator layer of a spiral patch radiator.

Referring now to FIG. 8 and 8B, a unit cell of a spiral-patch radiator 200 includes a spiral patch 198 disposed on a first surface 202*a* of a radiator layer 202. The spiral patch 198 is coupled to a pair of probes 192*a* and 192*b* which are disposed in the radiator layer 202. A feed circuit 196 is disposed between the radiator layer 122 and a middle layer 203, and is coupled to the probes 192*a* and 196*b*. The probes 192*a* and 192*b* are coupled to a MEMS substrate 205 through an aperture coupler 206 which is disposed between the middle layer 203 and the MEMS substrate 205. An array antenna includes a plurality of the spiral-patch radiators.

In one embodiment, the spiral-patch 198 is a symmetrical equiangular spiral having two separate spiral traces 190*a* and 190*b*, as shown in FIG. 8A. Alternatively, the spiral-patch can have an arbitrary spiral shape.

In operation, narrow band circularly polarized (CP) excitation of the spiral-patch 198, here for example the equiangular spiral-patch 198, produces circularly polarized signals. In one embodiment, the spiral-patch 198 is center fed by the feed circuit 196 as shown in FIG. 8B. It will be appreciated by those of ordinary skill in the art, that the spiral-patch can alternatively be end fed.

The use of aperture coupling and only two probes 192*a* and 192*b* per unit cell provides low loss characteristics which eliminate the requirement of additional amplifiers between the layers and facilitates relatively low cost manufacturing and relatively low profile construction.

Figure 9:
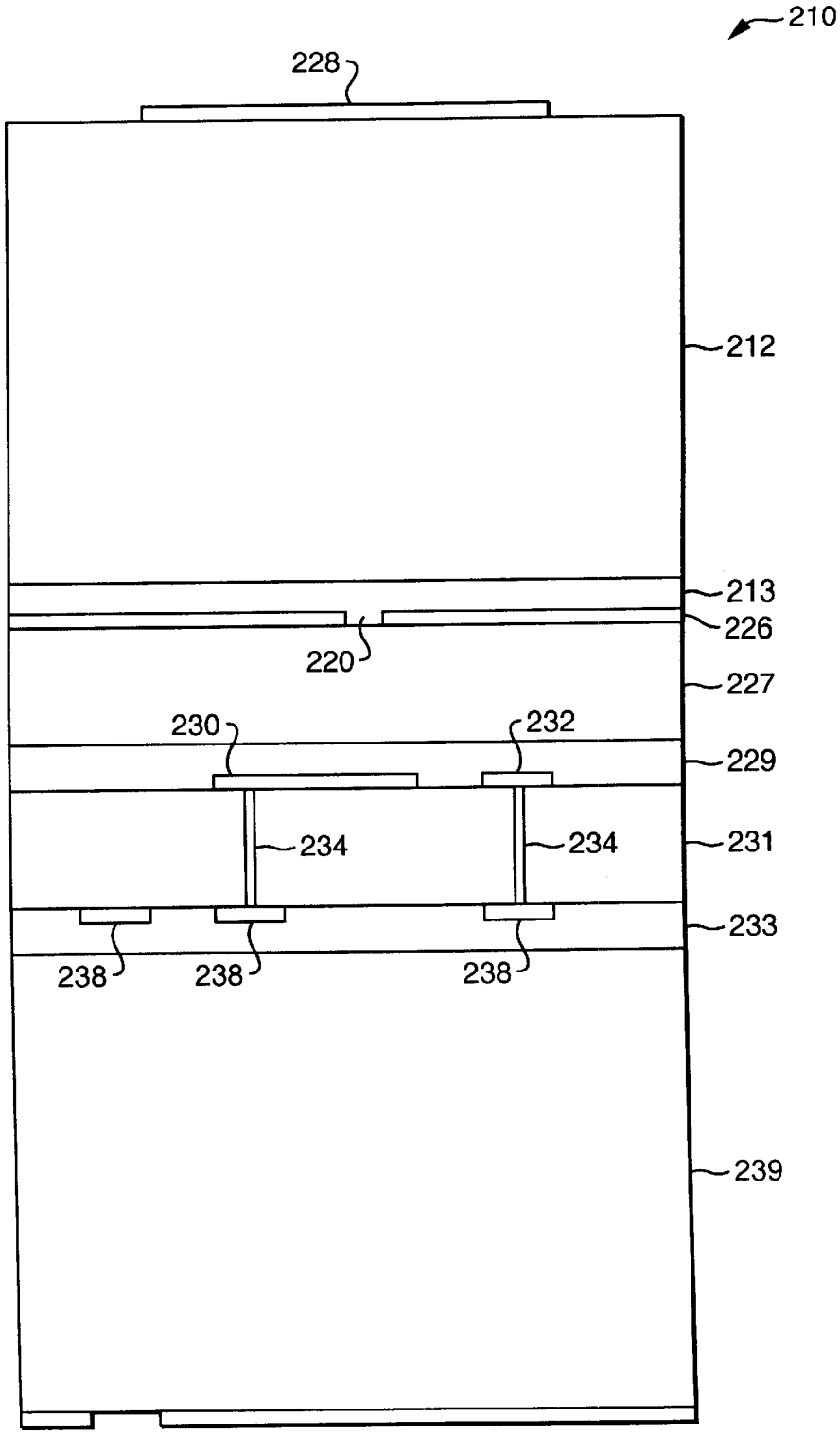
FIG. 9 is a cross-sectional view of an aperture coupled patch radiator.

Referring to FIG. 9, a unit cell of an aperture coupled patch radiator 210 includes a patch 228 disposed on a first dielectric layer 212 which is disposed on a support layer 213. The support layer 213 is disposed on a slot layer 226 which includes a slot 220 aligned with respect to the patch 228. The slot 220 is an aperture formed by conventional etching techniques. In one embodiment, the slot layer 226 is copper. The slot layer 226 is disposed on a slot dielectric layer 227 which is disposed on a slot support layer 229. The slot 220 is electromagnetically coupled to feed elements 230 and 232 which are disposed on a feed support layer 231. The feed support layer 231 is disposed on a hybrid circuit layer 233. The hybrid circuit layer 233 includes a hybrid circuit 238 which is coupled to the feed elements 230 and 232 through via's 234. The hybrid circuit layer 233 is disposed on a MEMS substrate layer 239.

In one particular embodiment, the support layers 229 and 231 are conventional dielectric material (e.g. Rogers R/T Duroid®). To produce signals having a circular polarization balanced feed configuration, a stripline quadrature hybrid circuit 238 combines the signals from the MEMS substrate layer 239 in phase quadrature (i.e., 90° phase difference). Unlike a probe feed arrangement, the balanced four-slot feed arrangement can realize circular polarization, minimize unbalanced complex voltage excitations between the stripline feeds and therefore reduce degradation of axial ratio with scan angle. This configuration provides for relatively strong scanned antenna beam signals away from the principle axes of the antenna aperture. It will be appreciated by those of ordinary skill in the art, that in order to produce signals having linear polarization, one pair of co-linear slots is removed and one slot replaces the other pair of co-linear slots. A single strip transmission line feeds the single slot thus realizing linear polarization.

Figure 9A:
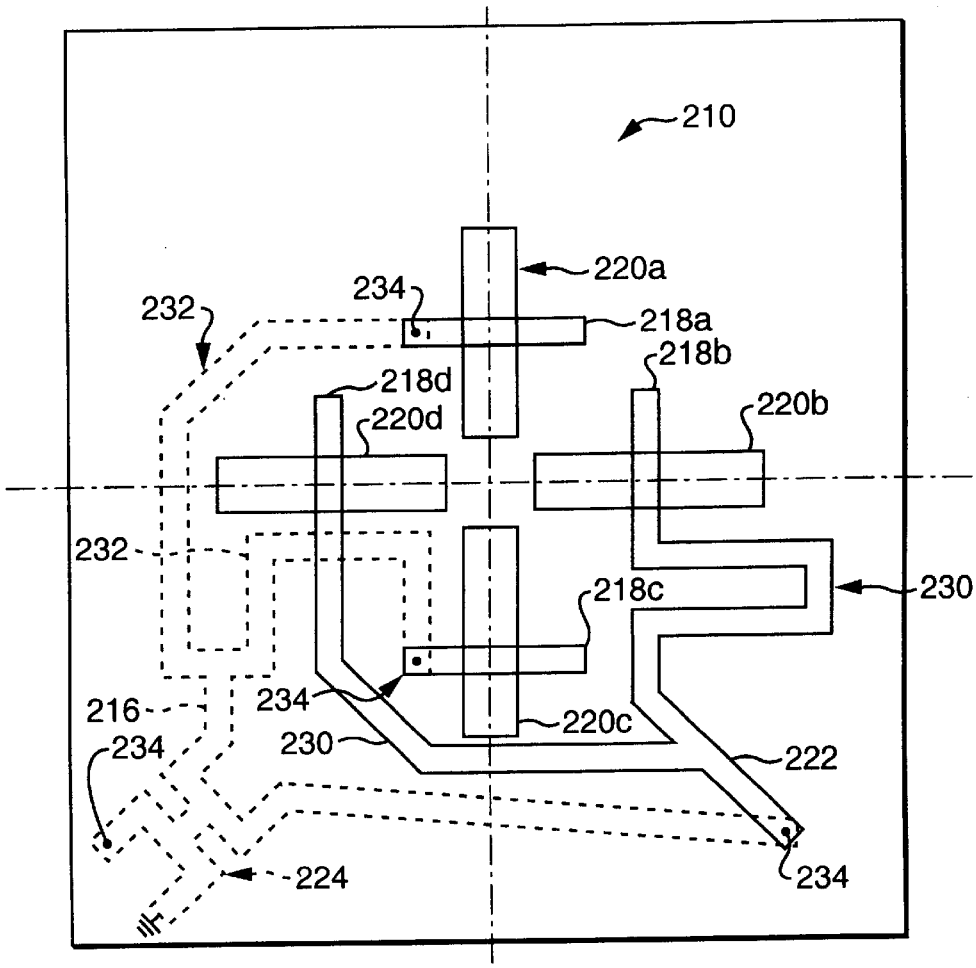
FIG. 9A is a schematic of the circuit layout of the aperture coupled patch radiator of FIG. 9.

Referring now to FIG. 9A, the aperture coupled patch radiator 210 circuit includes a plurality of feed elements 230 and 232. Each of the plurality of feed elements is coupled to a respective port of a hybrid circuit 224 through stripline transmission line feeds 222 and 216 and via's 234. Each feed element couples RF energy to a non-resonant slot 220*a*–220*d* respectively which is located above the stripline feeds 216 and 222, here for example four slots. Stripline transmission line feeds 222 and 216 include corresponding transmission line stubs 218*a* -218d. The slots 220*a*–220*d* are located on the separate slot layer 226 (FIG. 9). The 4-aperture circuit of FIG. 9A depicts a single unit cell, but it should be appreciated various sized arrays, spacing, various geometry (i.e., triangular, square, rectangular, circular, etc.) and various slot 220 geometry and configuration can be used (e.g., single, full length slot or two orthogonal slots).

In one embodiment, the hybrid circuit 224 is provided as a conductive trace on the feed support layer 231 (FIG. 9) with conductive plated-through-holes or via's 234 providing the coupling to the patch radiator 228 through feed elements 230 and 232 and through slot 220. Depending on the arrangement of the stripline feeds 216 and 222, a linear, dual linear, or circular polarization mode of operation can be achieved. The feed configuration can be operated in a dual-linear or circularly polarized system.

Figure 9B:
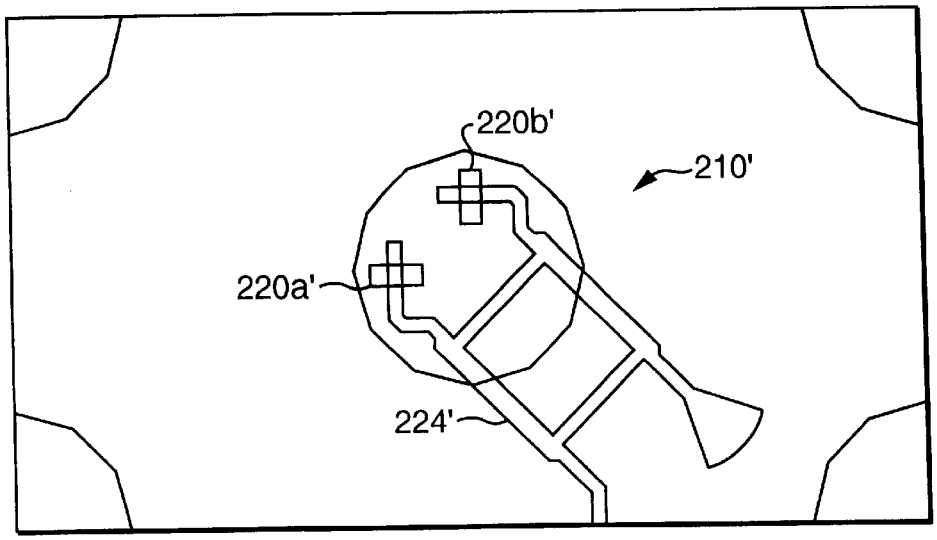
FIG. 9B is a schematic of the circuit layout of a 2-aperture polarizer embodiment of the aperture coupled patch radiator of FIG. 9.

Referring now to FIG. 9B, a circuit layout representing a 2-aperture polarizer unit cell circuit 210' embodiment of the aperture coupled patch radiator 210 of FIG. 9 is shown. The 2*a* perture polarizer unit cell circuit 210' includes a pair of slots 220*a*' and 220*b*' electromagnetically coupled to a hybrid circuit 224'. Because the integration of the MEMS phase shifters including aperture coupling and the reduced PTH count per unit cell (four PTH's in the case of the 4-aperture circuit, or no PTH's in the 2-aperture circuit), the integrated antenna assembly including an plurality of the aperture coupled patch radiators has relatively low loss characteristics and does not require additional power amplifiers and associated signal, power and control connections to be in inserted between the adjacent layers. The absence of these additional interconnections, allows the fabrication of a relatively low profile and relatively low cost antenna system.

Figure 10:
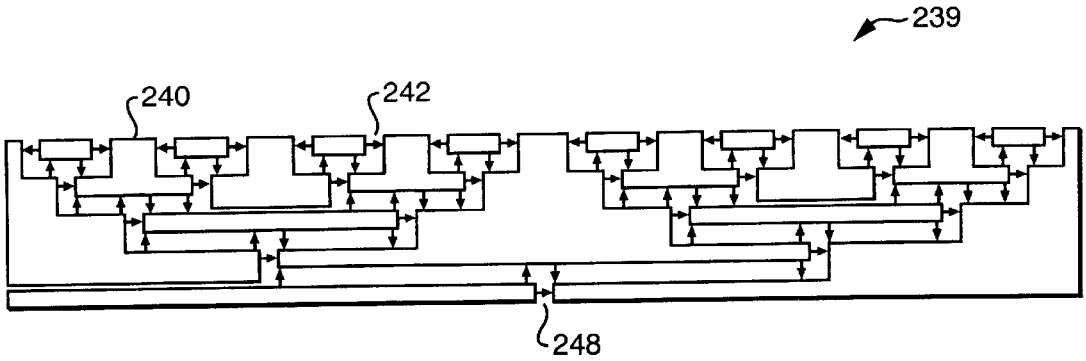
FIG. 10 is a cross-sectional view of an E-plane T-beamformer.
Figure 10A:
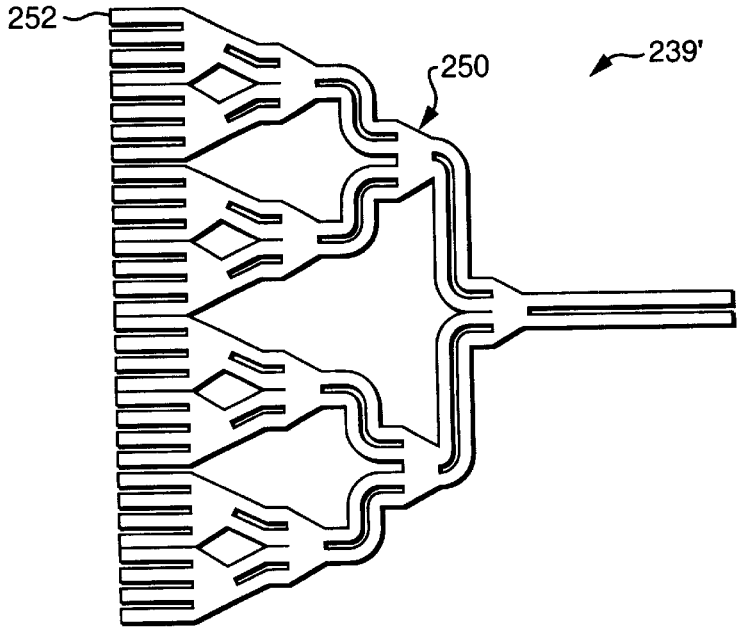
FIG. 10A is a view of the E-plane T-beamformer of FIG. 10.

Referring now to FIG. 10, an E-plane Tee beamformer 239 includes a plurality of channels 242 disposed in a structure 240. The channels 242 form the signal paths which carry signals to and from the radiating elements (not shown). Channel 248 is coupled to channel 252 (FIG. 10A). A typical feed network uses an arrangement of E-plane tees in parallel plate waveguide, which results in a low loss, compact network that sets up the boundaries for the subarray. A typical subarray can include 256 unit cells, the signals from which are combined by the feed network. In one embodiment, the E-plane Tee beamformer 239 produces an electric field, which, when separated, results in a 16:1 in-phase excitation. An orthogonal 16:1 waveguide divider 239', as shown in FIG. 10A, completes the 256:1 (162:1) feed network. A single diplexer (not shown) is used as a discrete device to separate the transmit and receive signals at the subarray.

Referring now to FIG. 10A, a orthogonal 16:1 waveguide divider 239'of the E-plane Tee beamformer 239 (FIG. 10) includes a plurality of channels 252 coupled to channels 250 which form the signal paths which carry signals to and from the radiating elements. The E-plane Tee beamformer be of the type as described in U.S. Pat. No. 6,101,705 entitled "Methods of Fabricating True-Time-Delay Continuous Transverse Stub Array Antennas", issued on Aug. 15, 2000, assigned to the assignee of the present invention and incorporated herein by reference in its entirety and U.S. Pat. No. 6,075,494 entitled "Compact, Ultra-Wideband, Antenna Feed Architecture Comprising A Multistage, Multilevel Network of Constant Reflection-Coefficient Components", issued on Jun. 13, 2000, assigned to the assignee of the present invention and incorporated herein by reference in its entirety.

Figure 11:
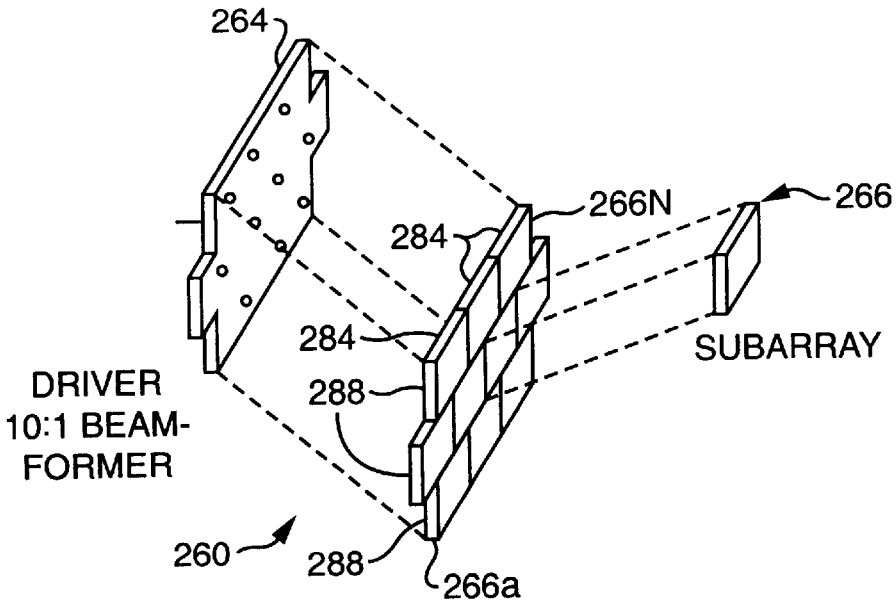
FIG. 11 is a partially exploded perspective view of an alternate embodiment of the antenna array including subarrays.
Figure 11B:
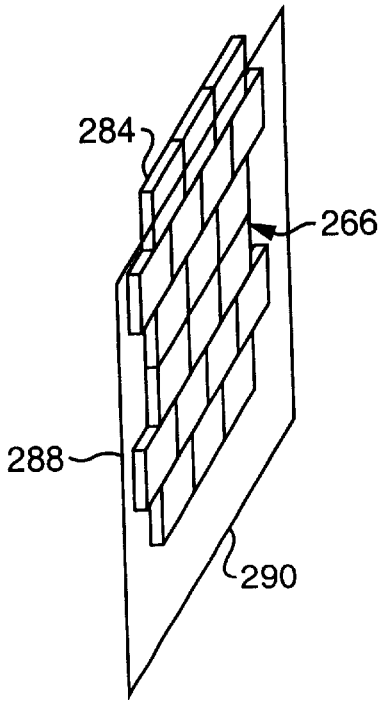
FIG. 11B is a block diagram view of the antenna array of FIG. 11
Figure 11A:
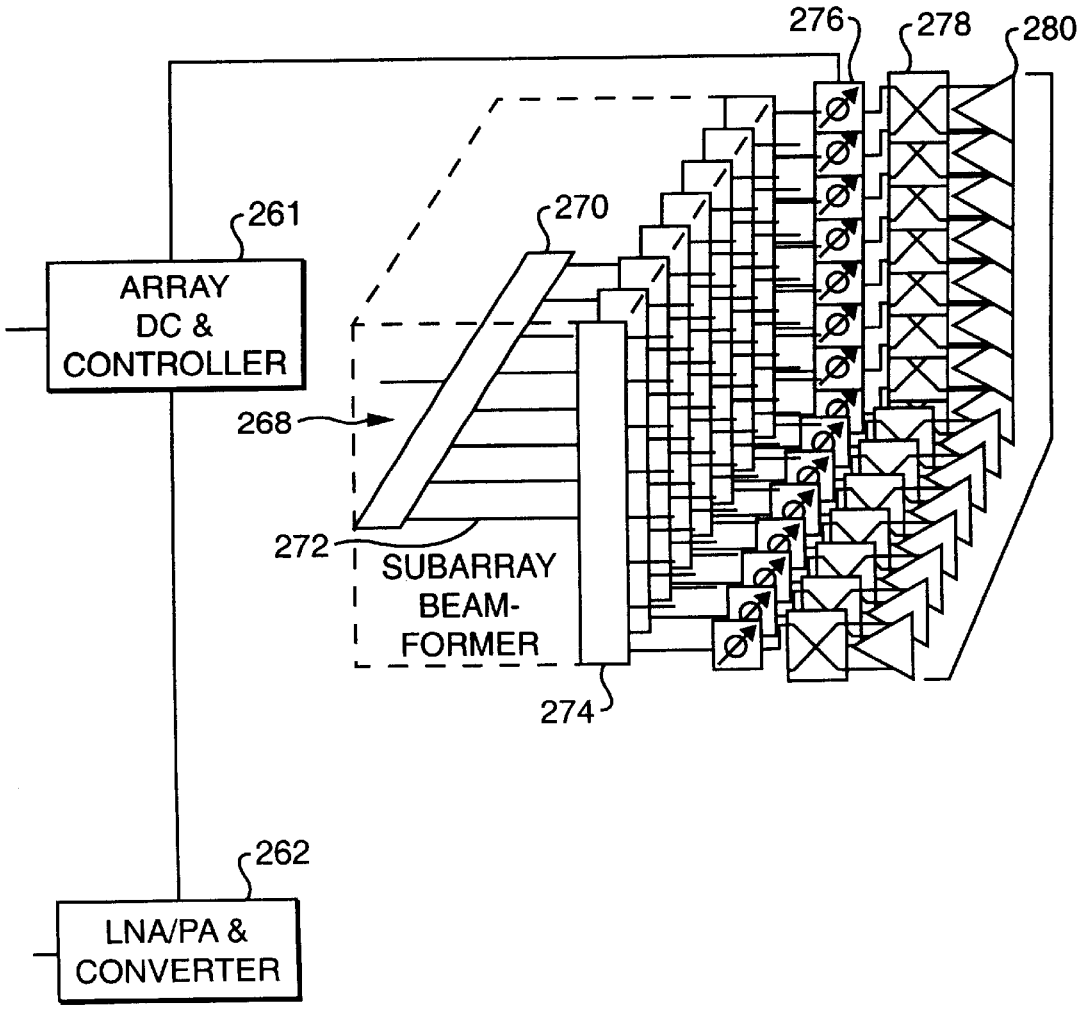
FIG. 11A is a block diagram view of the antenna array of FIG. 11.

Referring now to FIGS. 11, 11A and 11B, an integrated antenna array 260 includes a driver 264 coupled to a plurality of subarrays $\mathbf{266}_a$–$\mathbf{266}_N$ arranged in rows 288 and columns 284. In contrast to the radial shape of the beamformer and radiator layer of the antenna array shown above in FIG. 2, the antenna array 260 has a rectangular shape 290 (FIG. 11B). The driver 264 in one embodiment is a 10:1 beamformer constructed using the technique as shown with the E-plane Tee beamformer 239 shown in FIG. 10A.

As shown in FIG. 11A, an array direct current (DC) distribution and controller module 261 is coupled to both the LNA/PA and converter module 262 and to a plurality of MEMS phase shifters 278 provided in a phase shifter layer. The module 261 provides power to the MEMS phase shifters 278 which are provided in one embodiment as MEMS phase shifters.

The subarray 266 includes an array beamformer 268 having a first 16:1 beamformer circuit 270. Each of a plurality of output ports 272 of the first beamformer circuit 270 is coupled to corresponding input port of a second plurality of 16:1 beamformer circuits 274. Each of a plurality of outputs of the second plurality of beamformer circuits 274 is coupled to a first port of respective one of a plurality of MEMS phase shifter circuits 276. A second port of each of the plurality of MEMS phase shifter circuits 276 is coupled to a first port a plurality of hybrid circuits 278. It should be noted that each of the hybrid circuits 278 is provided as a four port device and that two of the hybrid ports are coupled to different MEMS phase shifters 276 and two of the hybrid ports are coupled to a single one of a plurality of radiating elements 280. Thus, each of the radiating elements $\mathbf{280}_a$–$\mathbf{280}_N$ have a pair of antenna ports with each of the antenna ports coupled to first and second ports of respective ones of the hybrid coupler circuits 46.

Optionally, multiple amplifiers (not shown) can be added coupled to subarrays $266_a$–$266_N$ in contrast to the antenna shown above in FIG. 2. Because the integration of the MEMS phase shifters and the reduced number of interconnects provides the integrated antenna assembly having relatively low loss characteristics, the array antenna 260 as shown in FIG. 11 does not require additional power amplifiers and associated signal, power and control connections to be in inserted between the adjacent layers. The absence of these additional interconnections, allows the fabrication of a relatively low profile and relatively low cost antenna system.

Figure 12A:
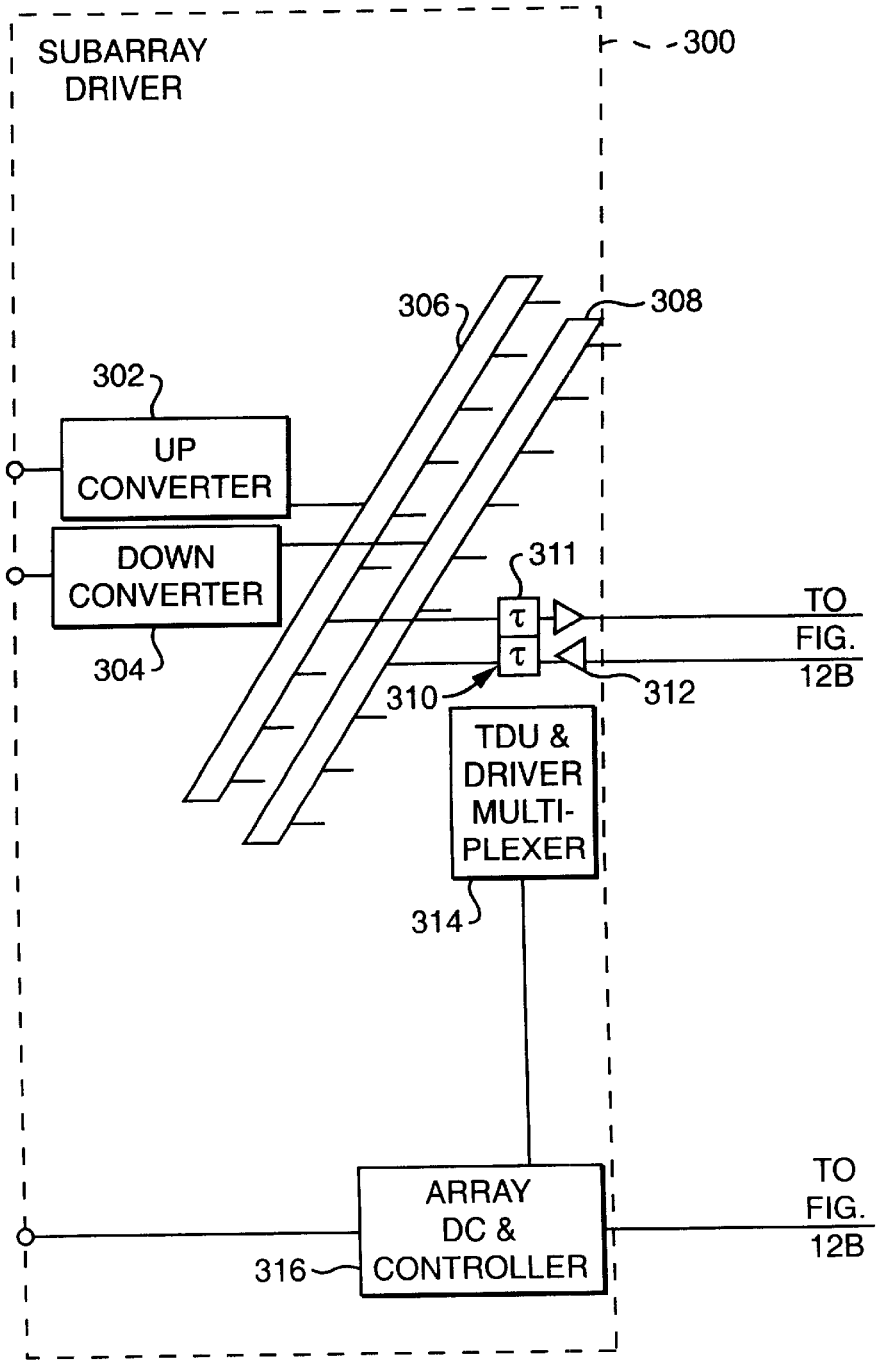
FIGS. 12A and 12B are a schematic block diagram of an alternate embodiment integrated electronically steerable phased array antenna system having common transmit receive radiators.
Figure 12B:
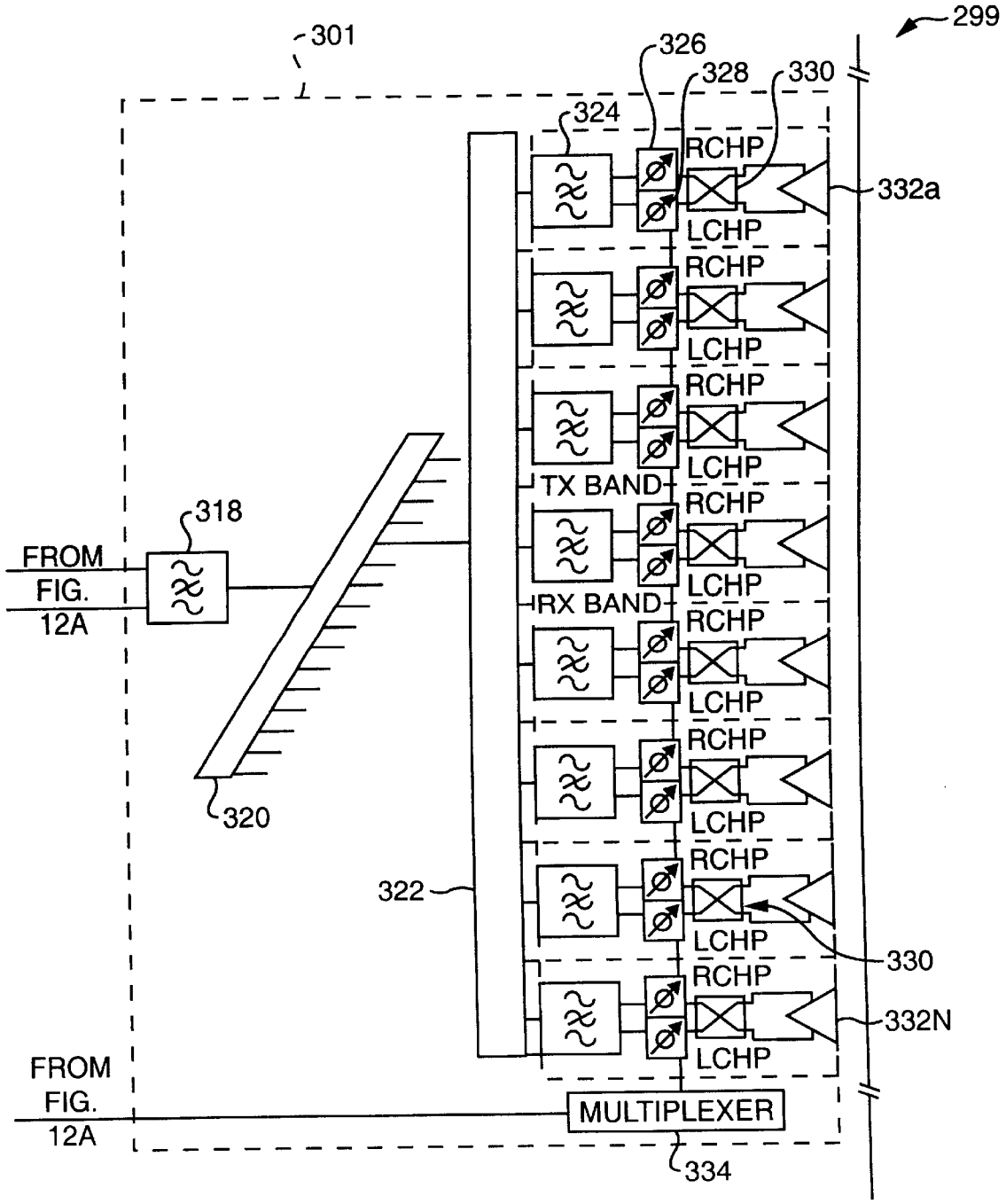

Referring now to FIGS. 12A and 12B, an integrated electronically steerable phased full duplex antenna array 299 includes a driver 300 coupled to an antenna subarray 301. The antenna array 299 includes a transmit signal path and a receive signal path.

In the transmit signal path, the driver 300 includes an upconverter module 302 coupled to a first port of a 10:1 transmit beamformer circuit 306. Each of a plurality of output ports of the beamformer circuit 306 is coupled through a time delay unit 311 to a transmit amplifier 313. Only one transmit amplifier 313 and one time delay unit 311 are here shown for clarity.

The transmit amplifier 313 provides an amplified signal to the antenna subarray 301 through a filter circuit 318 to a first port of a first 16:1 beamformer circuit 320. Each output of the beamformer circuit 320 is coupled to an input port of a second beamformer circuit 322. Each output of the second beamformer circuit 322 is coupled to a first port of a filter circuit 324. A pair of filter circuit 324 output ports is coupled to respective ones of MEMS phase shifter circuits 326, 328. The MEMS phase shifter circuits 326, 328 are coupled through a hybrid circuit 330 to a radiating element 332.

In the transmit signal path, each of the radiating elements $332_a$–$332_N$ have a pair of antenna ports with each of the antenna ports coupled to first and second ports of respective ones of the hybrid coupler circuits 330. Because each antenna subarray module uses a single low noise transmit amplifier 313, the number of signal interconnections, and control and power connections is reduced enabling the low loss interconnection between adjacent layers.

In the receive signal path, the driver 300 includes a downconverter module 304 coupled to a first port of a 10:1 transmit beamformer circuit 308. Each of a plurality of output ports of the beamformer circuit 308 is coupled through a time delay unit 311 to a receive amplifier 312. Only one receive amplifier 312 and one time delay unit 311 are here shown for clarity.

The receive amplifier 312 provides an amplified signal to the antenna subarray 301 through the filter circuit 318 to a first port of the first 16:1 beamformer circuit 320. Each output of the beamformer circuit 320 is coupled to an input port of the second beamformer circuit 322. Each output of the second beamformer circuit 322 is coupled to a first port of a diplexer 324. A pair of diplexer 324 output ports is coupled to respective ones of MEMS phase shifter circuits 326, 328. The MEMS phase shifter circuits 326, 328 are coupled through the hybrid circuit 330 to the radiating element 332.

In the receive signal path, each of the radiating elements $332_a$–$332_N$ have a pair of antenna ports with each of the antenna ports coupled to first and second ports of respective ones of the hybrid coupler circuits 330. Because each antenna subarray module uses a single low noise receive amplifier 312, the number of signal interconnections, and control and power connections is reduced enabling the low loss interconnection between adjacent layers.

When operating in receive mode, an incident plane wave signal passes through the radome (not shown) with minimal attenuation. The radiators convert this incident field into TEM fields at the two radiator ports for each unit cell of the antenna. In one embodiment, there are approximately 2,560 radiators, the boundary of each in the aperture plane functionally describing a unit cell. The two radiator ports at each unit cell represent the orthogonal linear polarization vectors of the incident field, these often being referred to as horizontal and vertical polarization. The two radiator ports 332 are connected to two of the four ports of the unit cell hybrid coupler circuits 330. The hybrid coupler circuits 330 converts the orthogonal linear vectors into two orthogonal circular polarized vectors. It does this by the introduction of positive and negative phase quadrature relationship between the two linearly polarized vectors. The two circularly polarized vectors, being right-hand circular polarization (RHCP) and left-hand (LHCP) occupy two separate sub-bands within the operating band. The diplexer 324 mixes these two signals with low insertion loss, resulting in two separate signals at the common port of the diplexer 324. This broadband signal is connected to one of the 256 ports of the feed network, the latter being comprised of two orthogonal set of 16:1 beamformers. It is important that the feed network operate across the operating band with low insertion loss, and this is accomplished in one embodiment using a set of E-plane tee dividers (FIG. 10) within a parallel plate waveguide structure. The feed network combines the signals of 256 unit cells to a single broadband port. This is then connected to a diplexer 324 of similar construction to the unit cell diplexer 324. This device operates in a mode opposite to that of the unit cell unit, thus separating the RHCP and LHCP signals. These separate RHCP and LHCP signals (which can be used as a transmit and receive signals respectively) are separately amplified and delayed before being combined in two separate 10:1 beamformers 308. Subarray amplification, true time delay and 10:1 beamforming, all occur in the subarray driver 300. Separate transmit and receive ports are coupled to the upconverter module 302 and downconverter module 304 respectively.

Conventional antenna systems typically include amplifier assemblies at each layer of the antenna array (i.e. at the subarray level). This results in a relatively large number of amplifiers as well as a relatively large number of amplifier interface connections. For example, input/output amplifier interfaces can exist at the aperture, and at the combiner (i.e. the multiple sets of N:1 beamformers). Also, required are the necessary DC, logic, RF interconnection, and support equipment including thermal control interfaces. This leads to a relatively complex mechanical assembly.

The antenna of the present invention, however, is provided as a relatively low loss antenna and thus does not require amplifiers at the subarray level. Rather, a single amplifier for a receive signal path and a single amplifier for a transmit signal path (e.g. amplifiers 312 and 313 of FIG. 12A) at the output of the beam former circuit can be used. Thus, the antenna system of the present invention includes transmit and receive signal paths which lead directly from the antenna aperture to the amplifier. In this manner, the antenna can be provided having a relatively simple mechanical structure.

By combining the layers in the manner shown in FIGS. 12A and 12B, an antenna having a relatively low loss characteristic is provided. In one embodiment, the feed network uses an arrangement of E-plane tees in parallel plate waveguide resulting in a relatively low loss, compact beamformer layer 18.

By providing separate transmit amplifiers 312, receive amplifiers 313, two layers of MEMS phase shifters 326, 328, this embodiment is able to operate in a full duplex mode in which the antenna 299 can simultaneously transmit and receive through a single aperture. Additionally the integrated electronically steerable phased full duplex antenna array 299 is capable of independently directing the transmit and receive beams to one of two satellites within its scan volume. The antenna 299 is designed to operate over a range of frequencies, and in one embodiment the range covers over a 55% bandwidth. The antenna has dual simultaneous polarization (i.e. the polarizations for the receive and transmit sub-bands are opposite sense circular and simultaneous). The active aperture in one embodiment is circular, and fully utilizes the area available, but the antenna 299 can be configured to provide an arbitrary aperture such as a rectangular aperture. The antenna uses a small number (10 in this embodiment) of transmit and receive amplifiers, having low internal losses to the complexity and cost associated with fully populated active phased array antennas. The design principles used allow the use of low cost, simple manufacturing techniques.

Figure 13:
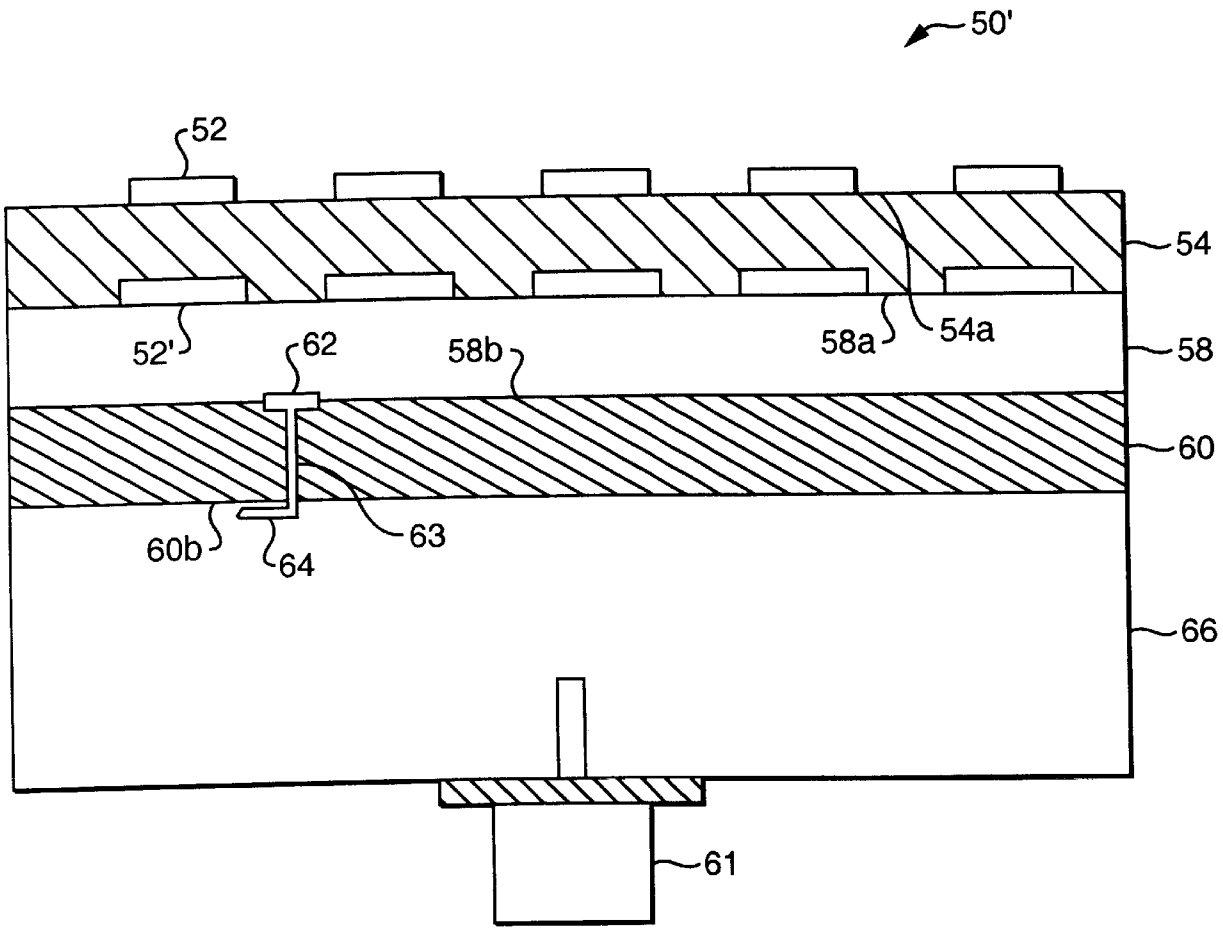
FIG. 13 is a cross-sectional view of a dual stack patch radiator.

Referring now to FIG. 13, in which like elements of FIG. 3 are provided having like reference designations, an integrated array antenna 50' includes a radiator layer 54 having a first surface 54*a* over which are disposed a first plurality of radiating antenna elements, or more simply radiators 52, here for example patches and a second opposing surface 54*b* disposed over a first surface 58*a* of a MEMS layer 58. The plurality of radiators 52 are coupled to the MEMS layer 58 by a second plurality of patches 52' disposed on a second surface 54*b* of the radiator layer 54. In one embodiment, the radiators 52 and 52' may be provided as patch radiators having a size and shape selected to be responsive to RF energy in a particular frequency range. The radiators may be provided having a rectangular shape, a circular shape or even an irregular shape. The particular size and shape of each of the radiators 52 and 52' is selected in accordance with the particular application in which the antenna 50 will be used.

The plurality of radiators 52 are coupled to a corresponding plurality of apertures disposed on surface 58*a* of the MEMS layer 58. A metal contact surface 58*b* of the MEMS layer 58 is disposed over a plurality of feeds 62 which are disposed on a first surface 60*a* of a spacer layer 60. A second surface 60*b* of the spacer layer 60 is disposed on over a first surface 66*a* of a beamformer layer 66. A plurality of via's 63 couples the plurality of feeds 62 to a plurality of plated coupling features 64 disposed on the second surface 60*b* of the spacer layer 60. A signal feed 61, here for example a single coaxial port is coupled to the beamformer layer 66. In this embodiment a combination of patch fed aperture connections and metal contact surface connections are used to couple the layers.

In operation as a receiver, an incident plane wave signal passes through the radome (not shown) with minimal attenuation. The radiators 52 convert this incident field into TEM fields. The received signal is electromagnetically coupled to the first surface 58*a* of the MEMS layer 58 through patches 246 to a corresponding aperture. The stacked patch arrangement (i.e. patches 52 and 52') provides a wider bandwidth than the single patch arrangement as shown in FIGS. 3 and 4.

The operation of the MEMS layer 58 and the signal feed 61 are similar to the operation as was described above in conjunction with the probe coupled embodiment of FIGS. 3 and 4. Because of the relatively low loss in the coupling from radiators 52 to the signal feed 61 there is no requirement for additional amplification between the adjacent layers of the array antenna 50.

Figure 14:
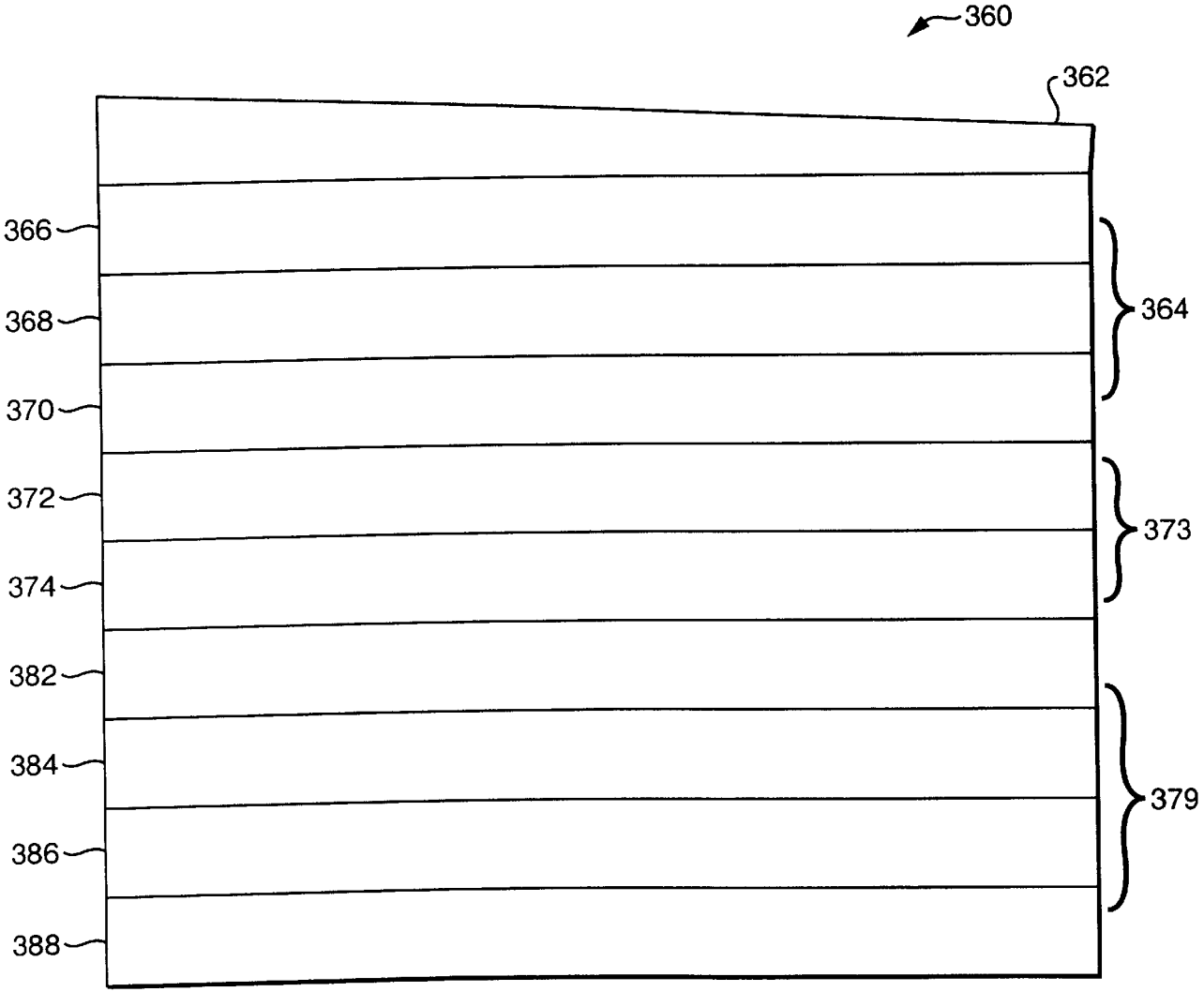
FIG. 14 is a cross-sectional view of the array antenna system of FIGS. 12A and 12B.

Referring now to FIG. 14, an integrated electronically steerable phased full-duplex antenna array 360 which may be similar to the antenna array 299 described in conjunction with Figs. 12A and 12B, includes a radome 362 disposed over a first surface 364*a* of a radiator layer 364. The radiator layer 364 is provided from a stacked patch layer 366 disposed on a row balancer/unbalancer (balun) 368 which is disposed on a column balun 370. The radiator layer 364 is disposed on a MEMS layer 373 which is provided from a MEMS transfer stripline layer 372 disposed on a MEMS phase shifter layer 374. The MEMS layer 373 is disposed on a feed layer 379 which is provided by a column beamformer circuit layer 382, a row beamformer circuit layer 384, a MEMS control card layer 386, and a 10:1 beamformer circuit layer 388.

In one embodiment, the integration of the multiple layers 366–388 provides the assembled antenna both low profile and planar with a relatively modest depth of less than 3 inches. The antenna is fixed during operation, since, as a phased array, the antenna directs the transmit and receive beams independently within a 50° scan volume. No motors are needed to operate the antenna in any way, so there no motor noise, or the single point failure modes associated with such devices. Instead, the antenna is designed to degrade gradually during its operation, with a sufficient number of functional unit cells at the end of its life to assure adequate performance.

Having described the preferred embodiments of the invention, it will now become apparent to one of ordinary skill in the art that other embodiments incorporating their concepts may be used. It is felt therefore that these embodiments should not be limited to disclosed embodiments but rather should be limited only by the spirit and scope of the appended claims.

All publications and references cited herein are expressly incorporated herein by reference in their entirety.

What is claimed is:

1. An antenna comprising:

a radiator layer having a first surface and a second opposing surface;

a first plurality of radiators disposed on the first surface of the radiator layer;

a microelectromechanical systems (MEMS) layer having a plurality of MEMS phase shifters disposed adjacent to the second surface of the radiator layer, each of the plurality of MEMS phase shifters electromagnetically coupled to at least one of the first plurality of radiators;

a beamformer layer electromagnetically coupled to the MEMS layer; and a spacer layer disposed between the MEMS layer and the beamformer layer.

2. The antenna of claim 1, further comprising a second plurality of radiators disposed on the second surface of the radiator layer, electromagnetically coupled to at least one of the first plurality of radiators and to at least one of the plurality of MEMS phase shifters.

3. The antenna of claim 1, wherein the radiator layer further comprises a plurality of polarizing circuits coupled to respective ones of the first plurality of radiators.

4. The antenna of claim 3 wherein each of the plurality of polarizing circuits comprises a hybrid circuit disposed between the MEMS layer and a respective radiator.

5. The antenna of claim 1 wherein the beamformer layer comprises a radial waveguide beamformer.

6. The antenna of claim 5 wherein the radial waveguide beamformer is a parallel plate radial waveguide beamformer.

7. The antenna of claim 1 wherein the first plurality of radiators is arranged in a radial pattern.

8. The antenna of claim 1 wherein the first plurality of radiators comprises a plurality of circularly polarized slot patch radiators.

9. The antenna of claim 8 wherein each of the plurality of circularly polarized slot patch radiators has a probe coupled to the MEMS layer.

10. The antenna of claim 8 wherein each of the plurality of circularly polarized slot fed patch radiators has an aperture electromagnetically coupled to the MEMS layer.

11. The antenna of claim 10 further comprising a 4-aperture circularly polarized hybrid circuit.

12. The antenna of claim 10 further comprising a 2-aperture circularly polarized hybrid circuit.

13. The antenna of claim 1 wherein the first plurality of radiators comprises a plurality of dual stacked patch radiators.

14. The antenna of claim 1 wherein the first plurality of radiators comprises a plurality of spiral patch radiators.

15. The antenna of claim 14 wherein each of the plurality of spiral patch radiators comprises a plurality of spiral traces.

16. The antenna of claim 1 further comprising a common radome having a transmit aperture and a receive aperture such that the antenna provides a transmit array and a receive array.

17. The antenna of claim 1 wherein the MEMS layer and the first plurality of radiators are coupled by at least one electromagnetic connection, such connection provided by at least one of:

a space feed; and a probe coupling mechanism.

18. The antenna of claim 17 wherein the space feed is provided as a plurality of apertures provided in the MEMS layer such that RF energy is coupled from the beamformer layer through the apertures to respective ones of the radiators.

19. The antenna of claim 18 wherein the MEMS layer further comprises a stripline transmission circuit coupled to the plurality of radiators and coupled to the plurality of MEMS phase shifters.

20. The antenna of claim 18 wherein each of the plurality of radiators is a substantially circular shaped patch radiator having a center; and each of the respective plurality of apertures comprises a rectangular shaped slot having a slot center.

21. The antenna of claim 20 wherein the patch center is offset from the slot center.

22. The antenna of claim 21 further comprising:

a probe coupled to the patch offset from the patch center; and and a coupling feature coupled to the probe and disposed between the patch and the slot.

23. The antenna of claim 17 wherein the probe coupling mechanism comprises a plurality of probes disposed in the radiator layer coupled to respective one of a plurality of radiators.

24. The antenna of claim 23 wherein the MEMS layer further comprises:

a metal contact surface coupled to the plurality of probes; and a stripline transmission circuit coupled to the metal contact surface and to the plurality of MEMS phase shifters.

25. The antenna of claim 24 further comprising a solder layer disposed between the metal contact surface and the stripline transmission circuit;

and wherein the metal contact surface is bonded to the stripline transmission circuit by solder reflow.

26. The antenna of claim 24 further comprising a conductive bonding layer disposed between the metal contact surface and the stripline transmission circuit;

and wherein the metal contact surface is bonded to the stripline transmission circuit by conductive bonding.

27. The antenna of claim 17 wherein the probe coupling mechanism comprises a plated through hole.

28. The antenna of claim 1 wherein the spacer layer comprises:

a first spacer layer surface and a second opposing spacer layer surface;

a plurality of coupling features disposed on the first spacer layer surface adjacent to the MEMS layer; and a plurality of feeds disposed on the second spacer layer surface coupled to respective ones of the plurality of coupling features by a plurality of the probes disposed in the spacer layer between the plurality of feeds and the plurality of coupling feature.

29. The antenna of claim 28 wherein the beamformer layer comprises a first beamformer layer surface and a second opposing beamformer layer surface; and a signal feed disposed on the second beamformer layer surface and electromagnetically coupled to the plurality of feeds disposed on the second spacer layer surface adjacent to the beamformer layer first surface.

30. The antenna of claim 29 wherein the signal feed comprises a coax feed.

31. The antenna of claim 1 wherein the spacer layer comprises:

a first spacer layer surface and a second opposing spacer layer surface;

a plurality of apertures disposed on the first spacer layer surface; and a plurality of feeds disposed on the second spacer layer surface electromagnetically coupled to respective ones of the plurality of apertures.

32. The antenna of claim 31 wherein the beamformer layer further comprising a first beamformer layer surface and a second opposing beamformer layer surface and a signal feed disposed on the second beamformer layer surface and electromagnetically coupled to the plurality of feeds disposed on the second spacer layer surface.

33. The antenna of claim 32 wherein the signal feed comprises a coax feed.

34. The antenna of claim 1 wherein the beamformer layer is provided as a radial waveguide beamformer; and the spacer layer is provided as a foam spacer layer.

35. The antenna of claim 1 wherein the beamformer layer and the MEMS layer comprise an integrated MEMS phase shifter and radiator.

36. The antenna of claim 1 wherein each of the plurality of MEMS phase shifters further comprises a plurality of capacitive switches coupled to the radiator;

each switch having an open position and a closed position such that when the respective switch is in the closed position each of the first plurality of radiators is coupled to a respective one of a plurality of stubs disposed on the first surface of the radiator layer.

37. The antenna of claim 36 wherein the radiator comprises a patch radiator.

38. The antenna of claim 1 wherein each of the plurality of MEMS phase shifters further comprises a plurality of capacitive switches coupled to the radiator;

each switch having an open position and a closed position such that when the respective switch is in the closed position each of the first plurality of radiators is coupled to at least one of a plurality of stubs disposed on the first surface of the radiator layer.

39. The antenna of claim 1 further comprising:

a beamformer having a plurality of beamformer ports disposed on the beamformer layer; and a plurality of diplexers having a first port, coupled to a respective plurality of beamformer ports, at least one receive port coupled to a respective one of the plurality of MEMS phase shifters, and at least one transmit port coupled to a respective one of the plurality of MEMS phase shifters.

40. An antenna comprising:

a subarray driver having a plurality of transmit circuits and a plurality of receive circuits;

a plurality of subarrays, each such subarray comprising:

a first diplexer having a transmit port and a receive port, the transmit port coupled to a respective one of the plurality of transmit circuits and the receive port coupled to a respective one of the plurality of the receive circuits;

a subarray beamforming layer having a plurality of output ports;

a plurality of second diplexers having a first port coupled to a respective one of the subarray output ports, a second port and a third port;

a microelectromechanical systems (MEMS) layer having a plurality of pairs of MEMS phase shifters, each of a second one of the pair coupled to a respective one of the second port of second diplexers, and each of a first one of the pair coupled to a respective one of the third port of second diplexers; and a plurality of radiators disposed on a radiator layer, each of the plurality of radiators coupled to a respective pair of MEMS phase shifters.

41. The antenna of claim 40 further comprising a radome have relatively minimal attenuation disposed on the plurality of subarrays.

42. The antenna of claim 40 wherein the subarray beamformer layer comprises a plurality of orthogonal N:1 beamformers.

43. The antenna of claim 40 wherein the subarray driver further comprises an E-plane tee beamformer.

44. The antenna of claim 43 wherein the E-plane tee beamformer comprises a plurality of conductive and relatively low loss foam layers.

45. The antenna of claim 44 wherein the E-plane tee beamformer further comprises an N:1 waveguide divider.

46. The antenna of claim 40 wherein the subarray driver further comprises:

a plurality of N:1 receive beamformers having a plurality of receive input ports and a receive output port coupled to a down converter; and a plurality of M:1 transmit beamformers having a plurality of transmit output ports and a transmit input port coupled to an up converter.

47. The antenna of claim 46 wherein the subarray driver further comprises:

a plurality of transmit time delay units, each transmit time delay unit coupled to a respective one of a plurality of transmit amplifiers and to a respective one of the plurality of transmit output ports; and a plurality of receive time delay units, each time delay unit coupled to a respective one of a plurality of receive amplifiers and to a respective one of the plurality of transmit output ports.

48. The antenna of claim 40 wherein the MEMS layer and the radiator layer are coupled using a plurality of apertures.

49. The antenna of claim 40 wherein the MEMS layer and the radiator layer are coupled using a plurality of probes.

50. The antenna of claim 40 wherein the MEMS layer and the first plurality of radiators are coupled by at least one electromagnetic connection, such connection provided by at least one of:

a space feed; and a probe coupling mechanism.

51. The antenna of claim 40 wherein each subarray driver further comprises a spacer layer comprising:

first a space layer surface and a second opposing spacer layer surface;

a plurality of coupling features disposed on the first spacer layer surface adjacent to the MEMS layer; and a plurality of feeds disposed on the second spacer layer surface coupled to respective ones of the plurality of coupling features by a plurality of the probes disposed in the spacer layer between the plurality of feeds and the plurality of coupling features.

52. The antenna of claim 40 wherein each of the plurality of MEMS phase shifters further comprises a plurality of capacitive switches coupled to the radiator, each switch having an open position and a closed position such that when the respective switch is in the closed position each of the first plurality of radiators is coupled to a respective one of a plurality of stubs disposed on the first surface of the radiator layer.

53. The antenna of claim 40 further comprising a plurality of hybrid circuits, each of the plurality of hybrid circuits disposed between the MEMS layer and a respective on of the plurality of radiators and coupled to a respective pair of the plurality of MEMS phase shifters.

54. The antenna of claim 53 wherein the hybrid circuit provides circularly polarized radio frequency energy.

55. The antenna of claim 40 wherein the driver further comprised an array direct current and controller module coupled to a time delay unit and driver multiplexer module.

56. The antenna of claim 55 wherein each of the plurality of subarrays further comprises a multiplexer coupled to the plurality of pairs of MEMS phase shifters.

57. The antenna of claim 40 wherein the subarray driver further comprises a feed layer having a column beamformer circuit layer disposed on a row beamformer circuit layer disposed on a MEMS control card layer disposed on an 10:1 beamformer circuit layer.

58. The antenna of claim 40 wherein the MEMS layer further comprises a MEMS transfer stripline layer.

59. The antenna of claim 40 wherein the radiator layer further comprises:

a row balun layer; and a column balun layer disposed on the row balun layer.

60. The antenna of claim 40 wherein the radiator layer further comprises a dual stacked patch radiator layer.

61. An antenna comprising:

a subarray driver;

a plurality of subarrays, each such subarray comprising:

a plurality of output ports and, a plurality of input ports;

a microelectromechanical systems (MEMS) layer having a plurality of MEMS phase shifters, each of the plurality of MEMS phase shifters coupled to a respective one of the subarray outputs; and a plurality of radiators disposed on a radiator layer, each of the plurality of radiators coupled to a respective one of the plurality of MEMS phase shifters.

62. The antenna of claim 61 comprising a transmit amplifier disposed between the subarray driver and each of the plurality of subarrays.

63. The antenna of claim 61 comprising a receive amplifier disposed between the subarray driver and each of the plurality of subarrays.

64. The antenna of claim 61 wherein the plurality of subarrays are arranged in a plurality of rows and a plurality of columns.

* * * * *

UNITED STATES PATENT AND TRADEMARK OFFICE

CERTIFICATE OF CORRECTION

PATENT NO. : 6,653,985 B2
DATED : November 25, 2003
INVENTOR(S) : Thomas V. Sikina et al.

It is certified that error appears in the above-identified patent and that said Letters Patent is hereby corrected as shown below:

Column 1,
Line 67, delete “on and the” and replace with -- on the --.

Column 2,
Line 17, deloete “ESA antenna.” and replace with -- ESA antennas. --.
Line 50, delete “antenna having” and replace with -- an antenna having --.
Line 61, delete “structures the” and replace with -- structures, the --.

Column 3,
Line 45, delete “simply” and replace with -- simple --.
Line 48, delete “DESCRIPTION OF THE DRAWINGS” and replace with -- BRIEF DESCRIPTION OF THE DRAWINGS --.
Line 60, delete “of the of the antenna” and replace with -- of the antenna --.

Column 5,
Line 18, delete “state a” and replace with -- state to a --.

Column 6,
Line 48, delete “having a relatively” and replace with -- having relatively --.

Column 9,
Line 41, delete “adjacent a” and replace with -- adjacent to a --.

Column 10,
Line 1, delete “plurality stubs” and replace with -- plurality of stubs --.
Line 32, delete “FIG. 8 and 8B,” and replace with -- FIGS. 8 and 8B, --.

Column 11,
Line 39, delete “spacing” and replace with -- spacings --.
Line 40, delete “geometry” and replace with -- geometries --.
Line 41, delete “geometry and configuration” and replace with -- geometries and configurations --.
Line 55, delete “2a perture” and replace with -- 2-aperture --.
Line 61, delete “an plurality” and replace with -- a plurality --.

Column 12,
Line 14, delete “(162:1)” and replace with -- ($16^2$:1) --.
Line 22, delete “be of” and replace with -- is of --.

UNITED STATES PATENT AND TRADEMARK OFFICE

CERTIFICATE OF CORRECTION

PATENT NO. : 6,653,985 B2
DATED : November 25, 2003
INVENTOR(S) : Thomas V. Sikina et al.

It is certified that error appears in the above-identified patent and that said Letters Patent is hereby corrected as shown below:

Column 14,
Line 22, delete “set of” and replace with -- sets of --.
Line 52, delete “beam former” and replace with -- beamformer --.

Column 15,
Line 45, delete “this embodiment a” and replace with -- this embodiment, a --.
Line 60, delete “feed 61 there” and replace with -- feed 61, there --.

Column16,
Line 16, delete “So there no” and replace with -- So there is no --.

Column 17,
Line 43, delete “and a coupling” and replace with -- a coupling --.

Column 18,
Line 11, delete “coupling feature” and replace with -- coupling features --.

Column 20,
Line 23, delete “respective on” and replace with -- respective pair of --.

Signed and Sealed this

Tenth Day of August, 2004

JON W. DUDAS
*Acting Director of the United States Patent and Trademark Office*